US005719739A

United States Patent [19]

Horiguchi

[11] Patent Number: 5,719,739

[45] Date of Patent: Feb. 17, 1998

[54] STATIC ELIMINATOR

[76] Inventor: Noboru Horiguchi, 2969-1, Kawatsu-cho, Sakaide-shi, Kagawa-ken, Japan

[21] Appl. No.: 530,124

[22] PCT Filed: Jan. 10, 1995

[86] PCT No.: PCT/JP95/00010

§ 371 Date: Jan. 29, 1996

§ 102(e) Date: Jan. 29, 1996

[87] PCT Pub. No.: WO95/19690

PCT Pub. Date: Jul. 20, 1995

[30] Foreign Application Priority Data

Jan. 13, 1994 [JP] Japan ..... 6-002061

[51] Int. Cl.[6] ..... H05F 3/00

[52] U.S. Cl. ..... 361/220; 361/213; 361/212

[58] Field of Search ..... 361/220, 213, 361/218, 212, 216, 217, 221, 222

[56] References Cited

U.S. PATENT DOCUMENTS

| | | | |
|---|---|---|---|
| 3,984,730 | 10/1976 | Hunter . | |
| 4,186,421 | 1/1980 | Twitchett | 361/212 |
| 4,849,851 | 7/1989 | Cubbison | 361/212 |
| 5,057,966 | 10/1991 | Sakata et al. | 361/213 |
| 5,095,400 | 3/1992 | Saito | 361/220 |
| 5,247,420 | 9/1993 | Bakhoum | 361/212 |

FOREIGN PATENT DOCUMENTS

| | | |
|---|---|---|
| A2590103 | 5/1987 | France . |
| A9220201 | 12/1992 | WIPO . |

*Primary Examiner*—Jeffrey A. Gaffin
*Assistant Examiner*—Jason L. W. Kost
*Attorney, Agent, or Firm*—Lorusso & Loud

[57] ABSTRACT

A static eliminator for eliminating static electricity between the human body and a charged object or from the charged object itself. Static electricity is introduced from a charged object into a discharger for discharging the static electricity by an electrical discharge and an exothermic device for eliminating the static electricity as heat. Thus, static electricity is consumed by electrical discharge and generation of heat.

7 Claims, 27 Drawing Sheets

FIG. 26
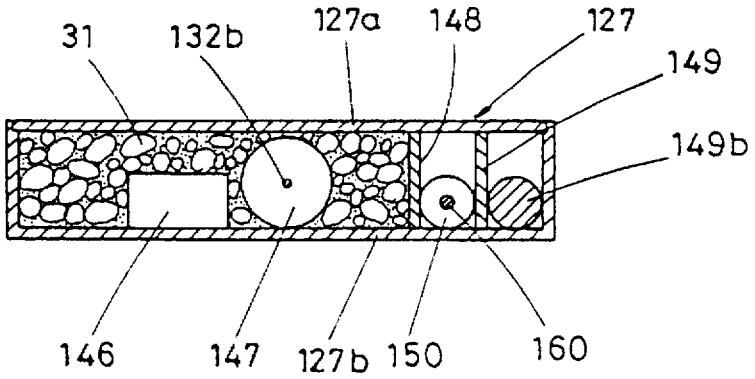
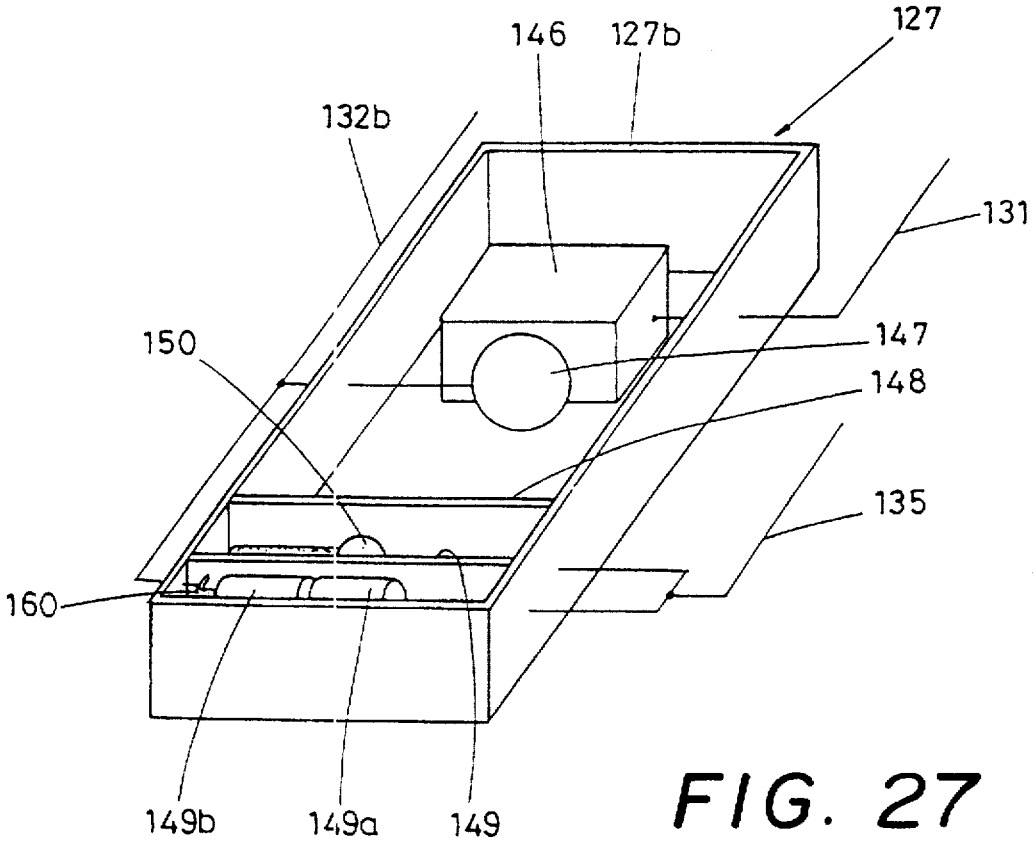
FIG. 27

FIG. 29
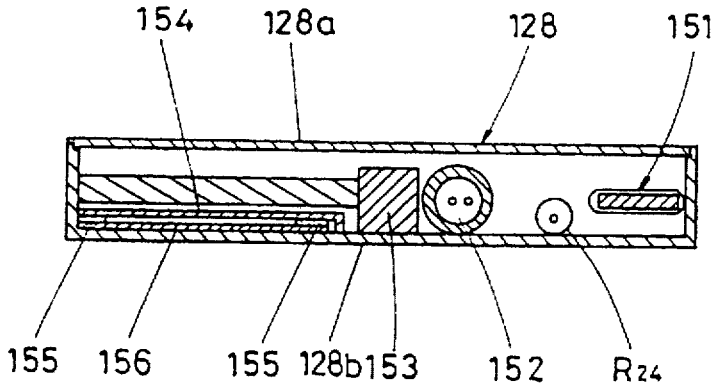
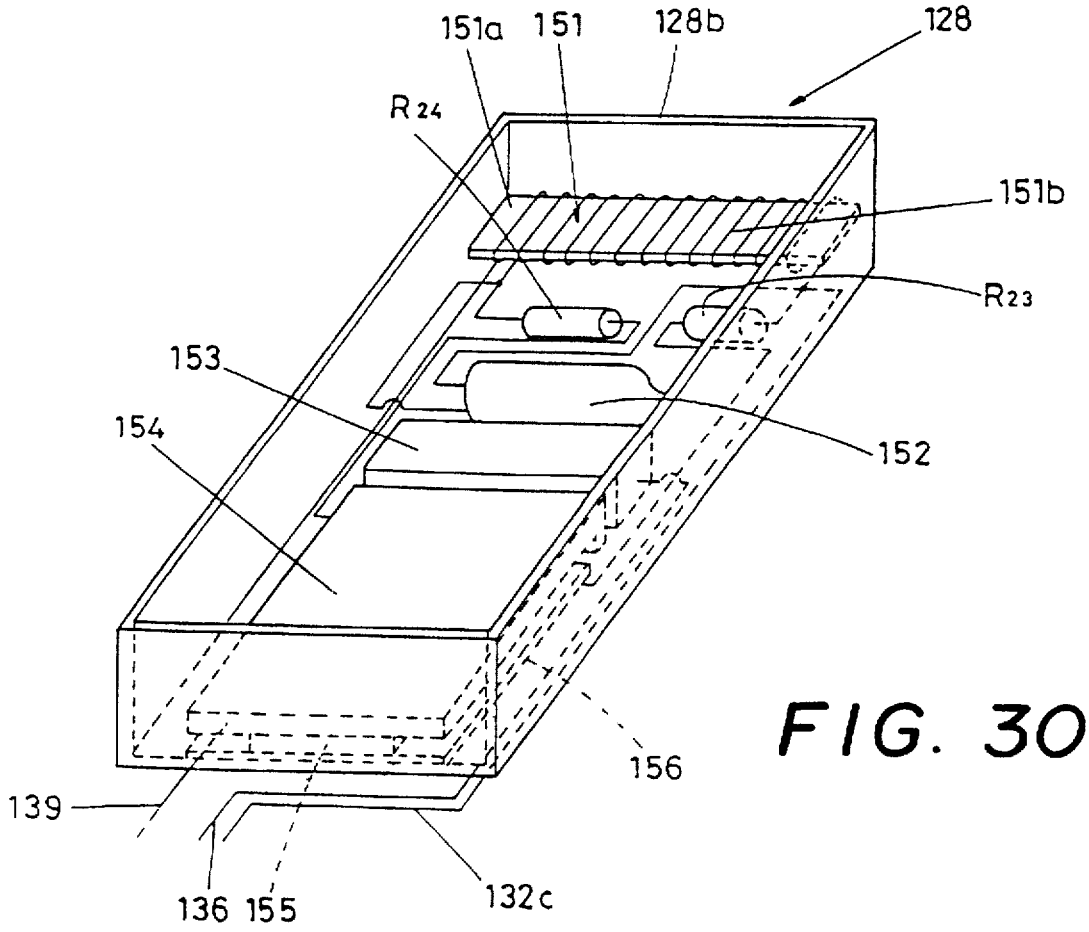
FIG. 30

STATIC ELIMINATOR

TECHNICAL BACKGROUND

The present invention relates to a static eliminator for preventing problems caused by static electricity.

BACKGROUND ART

When insulating materials such as, for example, celluloid objects, plastic articles, glass, carpet and so on are rubbed with another material, they can attract a small piece of paper, dirt or the like. Further, as clothes made of chemical fibers, such as sweaters and so on, are taken off in winter when the air is dry, there may occur a static sound and one may feel itchy, particularly in the case of underwear.

In addition, as one gets out of a car after driving and one touches the body of the car with a finger while one's feet are on the ground, one may feel itchy. At the same time noises may enter, for example, into a car radio when it is being turned on (electrical shock and RF fault).

These phenomena are due to the fact that an insulating material is charged with electricity by friction. The charging with electricity is a phenomenon that occurs when an electron existing in and traveling along the outermost orbit of an atom in one substance is caused to deviate from its original orbit and to move toward another substance.

An atom has a number of electrons that travel around the nucleus. As the number of the electrons is equal to the number of protons of the nucleus in a normal state, the substance normally keeps a neutral state in which it is well balanced electrically. Once a portion of electrons is removed from the atom by friction, however, the substance reduces its negative charge by the amount of the charge corresponding to the number of the lost electrons, while it increases its positive charge by an amount corresponding to the number of the lost electrons. As a consequence, the substance overall is positively charged. On the other hand, the other material with which the insulating material has been rubbed increases its negative charge with the addition of excessive electrons, whereby it is charged negative overall.

When two kinds of materials are rubbed with each other, one of the materials is charged with positive charges due to a loss of electrons while the other material is charged with negative charges due to an increase of electrons. Which material is negatively charged and which material is positively charged is determined by the two kinds of materials. When two different kinds of materials are rubbed with each other, one kind of the material is provided with positive charges while the other kind is negatively charged.

Such a phenomenon is not limited to insulating materials. Conductive materials are likewise charged by friction; however, they can allow charges (the amount of charged electricity) to be rapidly shifted to a lower potential side. Hence, such a phenomenon as described hereinabove is not recognized in conductive materials. On the other hand, insulating materials have a high resistance value so that a current (charge) is unlikely to travel through the insulating materials for discharge. Accordingly, once they are created, the charges are prone to stay at one location for a long period of time and they are referred to as static electricity.

The reason why static electricity occurs more frequently in a season such as winter, when air is dry rather than when air is wet, is because charges are unlikely to move toward the ground because the water content of air is less in winter.

An automobile is insulated from the road surface by tires and it is charged with electricity by friction between the body of the car and air while it is travelling. Further, a person seated therein is charged with electricity by friction with the seat due to vibration. In addition, as recent automobile cars are loaded with a large number of electronic devices, the body of the car can be charged with floating charges generated by those devices.

As the charge to be discharged from the charged body of the car has a very high potential, it is discharged with a static sound, even if a person standing on the ground merely brings a finger close to the body of the car. Generally, the amount of electricity so discharged is so small that the discharging itself terminates at a glance. Accordingly, the discharging of static electricity does not give the human body such a severe electrical shock as does general electricity and the human body merely feels itchy. To some persons, however, such an electrical shock is extremely unpleasant.

For a vehicle carrying fuel, such as a tank truck or the like, the risk exists that an unexpected accident might occur due to the discharge of charges put into the tank so that the static electricity is continuously discharged to the ground through a chain contacting the road surface for electrical connection with the ground. For general passenger cars, many drivers take similar measures by utilizing a conductive rubber material.

The occasions when one feels such an electrical shock by static electricity are not restricted to the case of cars as described hereinabove and one likewise perceives an electrical shock by static electricity, for example, when one touches a door knob in a hotel.

On the other hand, when one walks on a floor made out of concrete, wooden material, tiles coated with wax, carpet, dirty conductive mat or conductive tiles, or the like, the human body generates charges having a considerably high potential of static electricity. As a consequence, there is the possibility that the human body may undesirably influence other objects due to its static electricity. Appropriate examples can be seen, for example, in IC and LSI plants.

In order to protect parts particularly sensitive to static electricity from the risk of destruction by charges received from the human body, workers have hitherto put on a human-body grounding device such as a wrist strap, thereby discharging the charges from the human body to the ground with safety. In other words, the wrist strap is so arranged as to make the potential at the hand or fingers zero relative to electrical and electronic parts by grounding the skin of the person in order to exert no undesirable influences upon the operation of electrical and electronic components.

As described hereinabove, there are two kinds of problems of static electricity involving the human body, one being the affect upon the human body by a charged object and the other being the affect upon an object from the human body.

The adverse effects caused by static electricity as described herein above, however, can be prevented by grounding the object side or the human body side.

It should be noted that problems may still remain, however, even with grounding means utilizing a chain mounted on the vehicle due to the fact that the road surface is generally covered with concrete, asphalt or the like and the grounding means will have poor contact with such a road surface.

The wrist strap can effectively prevent the problems caused by static electricity when used in IC and LSI plants as long as the human body is well connected to ground; however, it presents the problem that, because the human body is always connected through wiring to the ground, freedom of movement is impaired. Further, many buildings recently built are not provided with any grounding in electric power outlets adapted for dissipation of static electricity. Further, recently, the problems caused by static electricity can often be seen in office automation equipment such as personal computers and so on, medical treatment equipment utilizing static electricity, various kinds of electrical and electronic equipment such as electronic ovens, etc. Thus, prevention of failure or accident with general electrical equipment due to static electricity is a problem still left unsettled.

One problem with electrical and electronic equipment due to static electricity, as is already known, is that variation in the amount of charge on the equipment can adversely influence performance of the equipment. However, in practice, it is difficult to prevent the problems caused by static electricity because the charging with static electricity is a natural phenomenon that cannot be predicted in advance.

In particular, use of electrical equipment such as medical treatment devices of the static type utilizing a very high potential (e.g. 12 KV) is highly risky if no appropriate measures are taken for safe-guarding against an electrostatic shock. The problems associated with use of the electrical equipment in such a state are as follows:

(1) Although appropriate measures can be taken for removing static electricity by connecting the equipment to ground, the grounding reduces the effect of the treatment because a sufficiently high level of an ion electrical field becomes difficult to gain. Further, when the equipment is connected with the ground, a ground leakage breaker starts operating. Under these circumstances, it is initially impossible to connect the treatment equipment to ground.

(2) It may not be possible to connect the treatment equipment with ground at some locations where it is placed.

The present invention solves the problems associated with conventional means for preventing static electricity and addresses the difficult situation in which no effective means for preventing static electricity as described hereinabove can be found. Accordingly, the present invention has as its object provision of a static eliminator for discharging static electricity with certainty and that does not restrict the freedom of movement of a person in operation, in any respect, even if worn on the body of the person.

DISCLOSURE OF THE INVENTION

The present invention provides a static eliminator comprising: a static electricity introduction means for collecting static electricity from an object charged with static electricity; and a static electricity elimination means (circuit) for eliminating the collected static electricity introduced through the static electricity introduction means; wherein the static electricity elimination means comprises a discharging means for eliminating static electricity by means of a discharging action and an exothermic means for generating heat from and thus eliminating the static electricity.

In another aspect, the present invention provides a static eliminator, wherein the static electricity elimination means has the discharging means and the exothermic means divided into a plurality of groups having different performance for eliminating static electricity corresponding to the magnitude of charge of the charged object.

In a further aspect, the present invention provides a static eliminator, wherein either one of the discharging means or the exothermic means or both is or are enclosed by granitic earth, thereby forming a charge-absorptive structural member similar to a ground wire.

In a still further aspect, the present invention provides a static eliminator, wherein the discharging means is a corona discharge electrode and the exothermic means is a heater structure so configured as to generate Joule's heat from the potential and current of the static electricity.

The present invention having the structure as described hereinabove can be electrically connected with a charged object such as a human body, a car body, a door knob, electrical equipment, electronic equipment and the like through the static electricity introduction means of the static eliminator. The electrostatic charges of the object charged to a high voltage are led to each of the discharging means and the exothermic means of the static electricity elimination means through the static electricity introduction means and then discharged. At the same time, the charges are consumed as Joule's heat and effectively reduced to a lower potential and eventually eliminated. When the electric exothermic means is disposed in pairs with the discharging means, the Joule's heat generated at the time of discharging warms the discharging means and ambient temperature around the discharging means to an appropriate level.

As a result, ion charges in air or in a medium can move more actively at the time of discharging, thereby facilitating the discharging action and releasing the charge on the charged object more rapidly. Thus, the charges are neutralized and the charged potential is reduced more effectively.

Further, in these cases, the charged potential level of the charged object varies with the amount of the charge. Accordingly, the discharging means and the exothermic means can eliminate static electricity more effectively over a broad range of charge from a high potential level to a low potential level, when the discharging means and the exothermic means are composed of a plurality of groups corresponding to the magnitude of the capacities and exothermic performance of the discharging means and the exothermic means.

In addition, in the cases as described hereinabove, for example, granitic earth is filled around the discharging means and the exothermic means, thereby forming an electrostatic charge-absorption member capable of absorbing electrostatic charges similar to a ground wire. This structure can enhance performance of discharging and neutralizing the charges of static electricity due to the discharging and exothermic action more efficiently, thereby more effectively facilitating the reduction of static electricity in the charged object.

Furthermore, in the above-mentioned cases, the exothermic means utilizes, for example, a heater wire such as Nichrome™ wire, which has a high resistance to electricity and is capable of readily consuming an electric field current as Joule's heat. Further, when the heater wire is wound in a coil shape, the discharging capability and the consumption of a current can be increased to thereby improve the action for reducing static electricity to a greater extent.

In the embodiments as described hereinabove, too, when the discharging means comprises a discharge electrode, for example, a corona discharge electrode, static electricity can be effectively discharged. Further, when the discharge electrode comprises a spherical electrode, consisting of a ball of a metal such as iron, copper or the like, and disposed in electrical or mechanical contact with a Nichrome™ wire wound in a coil shape, and a sleeve-shaped electrode consisting of a metallic sleeve such as stainless steel having a predetermined discharging gap and enclosing the spherical electrode, and when a static electricity absorbing member in the form of granitic earth is filled around the heater and the discharging electrode, the performance for discharging and neutralizing static electricity is more efficient yet.

Therefore, the present invention can provide high effectiveness as if the static eliminator itself were connected directly with the ground.

Hence, for instance, when the static eliminator is to be carried by a person, it does not interfere at all with freedom of movement of the person.

In addition, even when the static eliminator is applied to electrical or electronic equipment, which have hitherto been difficult to adapt with a static eliminator, the problems with static electricity can be prevented without actually connecting the static eliminator to the ground. Therefore, the static eliminator according to the present invention can eliminate the risk of a breaker out of order and yet is extremely effective in preventing accumulation of static electricity.

BRIEF DESCRIPTION OF THE DRAWINGS

FIG. 26 is a sectional view taken along line D—D of FIG. 25.

FIG. 27 is a perspective view showing the configuration of the static electricity eliminating device according to the seventh embodiment of the present invention.

FIG. 29 is a cross-sectional view taken along line E—E of FIG. 28.

FIG. 30 is a perspective view showing the configuration of the static electricity eliminating device according to the eighth embodiment of the present invention.

BEST MODE OF CARRYING OUT THE INVENTION

FIGS. 1 to 8 illustrate a static eliminator according to a first embodiment of the present invention, which is, for example, a portable static eliminator adapted to be carried on the body of a person.

Figure 1:
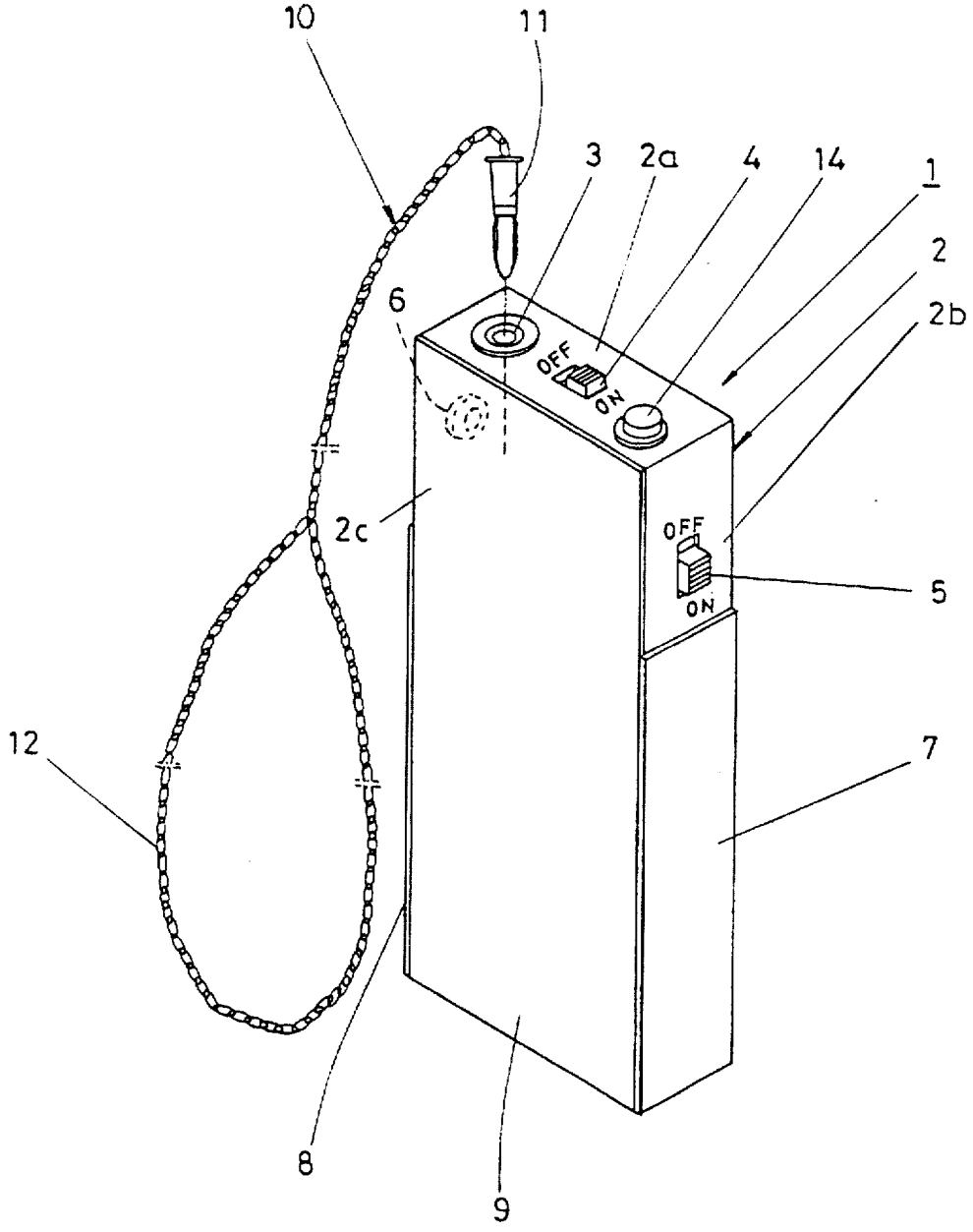
FIG. 1 is a perspective view of a housing of a static eliminator according to a first embodiment of the present invention.
Figure 2:
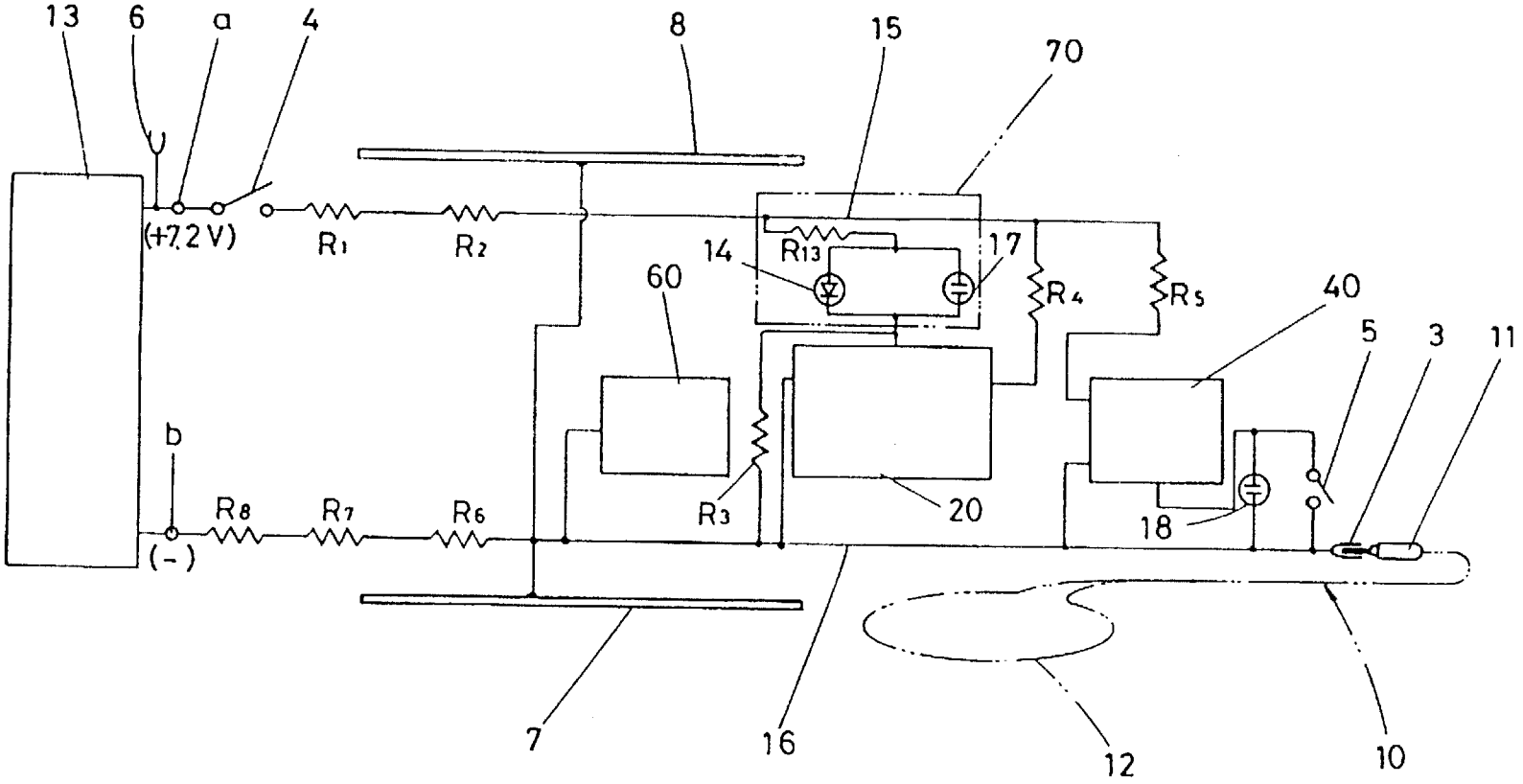
FIG. 2 is a wiring diagram showing the configuration of an electrical circuit of the static eliminator according to the first embodiment of the present invention.

FIG. 1 shows the structure of the housing of the portable static eliminator. In the drawings, reference numeral 1 denotes a housing of a box shape suitable for accommodation in a pocket or for carrying by hand. The box-shaped housing 1 comprises a body 2 having a predetermined depth and a lid 9 detachably mounted on an open side portion of the body 2. Inside the body 2, there are accommodated and disposed a variety of electrical and electronic parts and wiring constituting a static electricity elimination circuit for eliminating static electricity, for example, as shown in FIG. 2.

On a top side portion 2*a* of the body 2 of the box-shaped housing 1, there are disposed a ground plug socket 3, a power supply switch 4 and a light-emitting diode 14 (2 V, 15 mA) for displaying actions and residual charges, for the various electrical and electronic parts, at predetermined intervals. On each of two sides 2*b* and 2*c* is disposed an electrical field line short-circuiting switch 5, a ground electrode holding plate 7 to connect the body of the user to a ground line 16 as will be described hereinafter, a charging plug socket 6 for charging a battery, and a ground electrode holding plate 8 to connect the body of the user as will be described hereinafter.

Into the ground plug socket 3 can be detachably inserted a ground plug 11 connected to a chain 10 composed of a good conductive material such as gold, silver, copper or the like, the chain 10 having a necklace section 12 for connection as a ground line ("ground wire" for eliminating static electricity) to the body of the person.

A first embodiment for eliminating static electricity in accordance with the present invention will now be described with reference to FIG. 2. In the drawing, reference numeral 13 denotes a power supply such as, for example, a chargeable battery of DC 7.2 (V). To a (+) terminal a of the power supply 13 is connected a power supply line (power wire) 15 through the power supply switch 4, resistance R1 (300 Ω) and resistance R2 (1 kΩ). On the other hand, to a (−) terminal b of the power supply 13 is connected the ground line 16 through resistance R8 (300 Ω), resistance R7 (1 kΩ) and resistance R6 (1 kΩ).

To the opposite end of the ground wire 16 is connected the ground plug socket 3. To the ground line 16 are connected the ground electrode plates 7 and 8 as well as a third static electricity elimination device 60, as will be described hereinafter.

A first static electricity elimination device 20 and a second static electricity elimination device 40 are connected in parallel between the power supply wire 15 and the ground wire 16.

Figure 3:
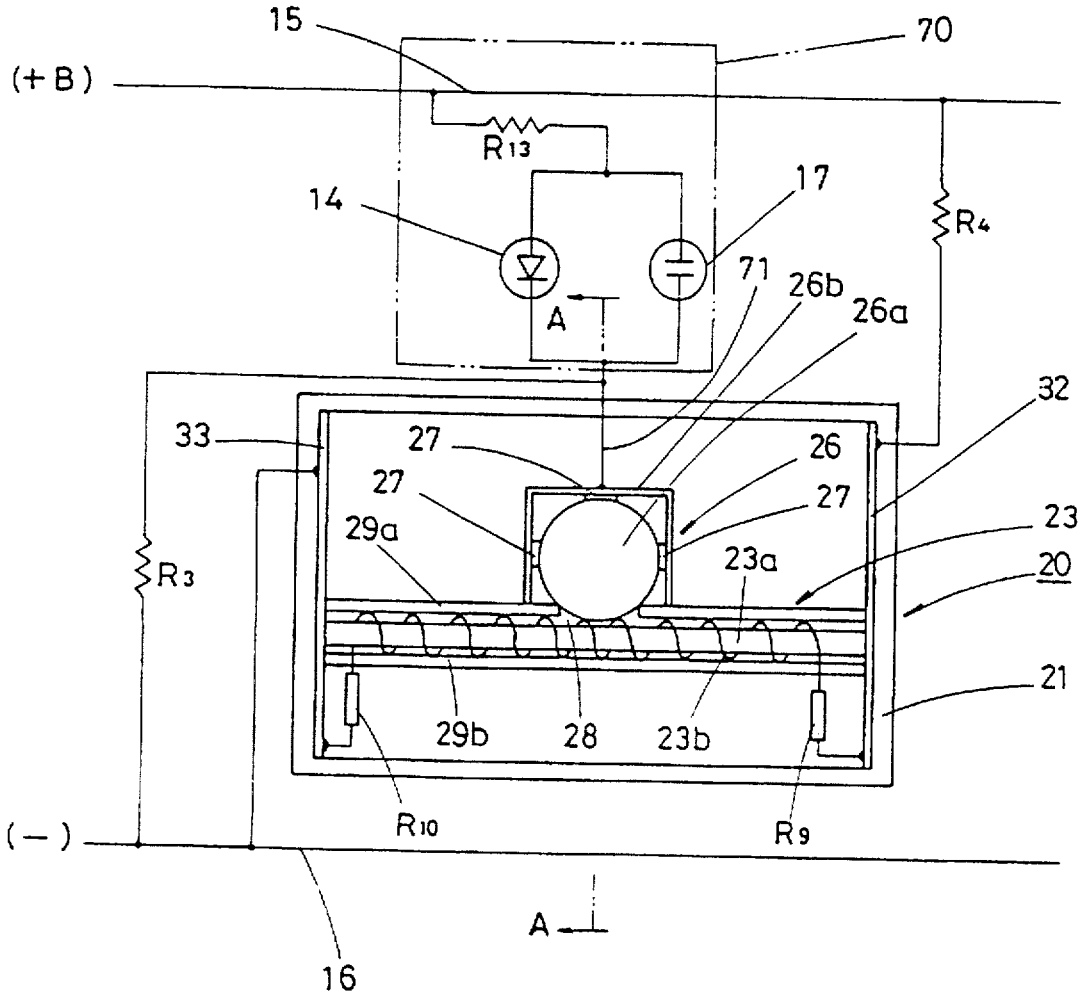
FIG. 3 is a view showing internal components of the static electricity eliminating device according to the first embodiment of the present invention.
Figure 4:
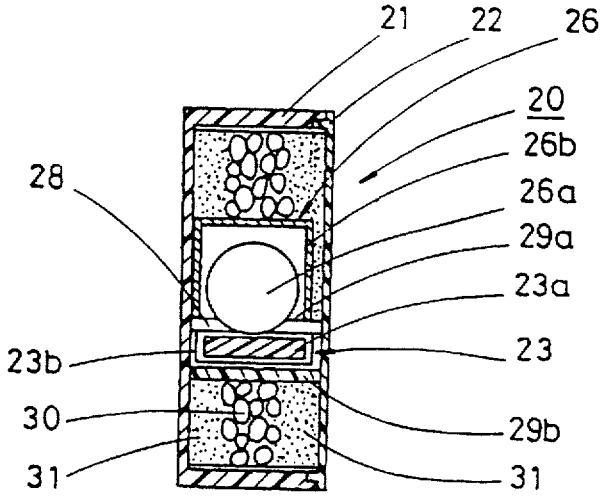
FIG. 4 is a sectional view taken along line A—A of FIG. 3.

As shown in detail in FIGS. 3 and 4, the first static electricity elimination device 20 comprises a casing 21 made of a non-electrically conductive synthetic resin and a lid 22. In the casing 21 are disposed a first heater 23 and a first discharging electrode 26. The first heater 23 comprises a core 23*a* made of an acrylic resin and a Nichrome™ wire coil 23*b* wound on the acrylic core 23*a*. The first discharge electrode 26 comprises an iron ball 26*a* serving as a first counter electrode and a stainless steel sleeve 26*b* of a cylindrical shape with a bottom, serving as a second counter electrode which is attached to the iron ball 26*b* through spacers 27, 27, . . . , each made of an acrylic resin. The first discharge electrode 26 is disposed in such a way that the iron ball 26*a* is in contact with the Nichrome™ wire coil 23*b*. In addition, a predetermined volume of granular pumice 30 and granitic earth 31 is filled in the acrylic casing 21 so as to enclose the first heater 23 and the first discharge electrode 26. With the arrangement as described hereinabove, the first discharge electrode 26 functions as a corona discharge electrode to discharge electrostatic voltage introduced through the ground wire 16 and the Nichrome™ wire coil 23*b* as corona discharge in radial directions from the iron ball 26*a* toward the stainless steel sleeve 26*b*.

The first heater 23 is provided with insulation plates 29*a* and 29*b*, each made of an acrylic resin, at its upper and lower surfaces, respectively, and disposed astride right and left ends of the box-shaped casing 21. The upper insulation plate 29*a* has a cutaway groove 28 having a predetermined width formed in a middle portion extending in right and left directions. The iron ball 26*a* of the first discharge electrode 26 is disposed in such a fashion that it projects through the open end of the sleeve and through the cut-away groove 28, thereby coming into contact with the Nichrome™ wire coil 23*b* of the first heater 23. This arrangement allows electrostatic voltage to be applied from the ground wire 16 through the Nichrome™ wire coil 23*b* to generate heat from the Nichrome™ wire coil 23*b*. The Nichrome™ wire coil 23*b* of the first heater 23 functions to discharge a predetermined amount of electrostatic voltage introduced through the ground wire 16, i.e. it consumes electrostatic current by conversion into Joule's heat. Further, it facilitates the action of neutralization by discharge by elevating the temperature of the iron ball 26*a* of the first discharging electrode 26 and of the ambient temperature around the iron ball 26*a*.

The granular pumice is so disposed as a central layer 30 having a width approximately equal to the diameter of the iron ball 26*a*. On the other hand, the granitic earth forms layers 31 on both sides of the pumice layer 30. As a result, a combination of the pumice layer with the granitic earth layers gives high performance in absorbing electrostatic charges, which is similar to the effects of the ground of the earth, in association with the heater 23 mimicking magma.

Further, the stainless steel sleeve 26*b* of the first discharge electrode 26 is connected to a terminal on the ground wire of a fourth static electricity elimination device 70, as will be described hereinafter, through residual charge discharge wire 71. On the other hand, the positive side terminal of the Nichrome™ wire coil 23*b* of the first heater 23 is connected to the power supply line 15 through resistance R9 (10 kΩ), an electrically conductive plate 32 made of stainless steel and serving as one of the positive and negative, left and right, counter electrodes, and resistance R4 (1 kΩ). The negative side terminal thereof is connected to the ground line 16 through resistance R10 (1 kΩ), and an electrically conductive plate 33 made of stainless steel and serving as the other of the positive and negative, left and right, counter electrodes. Hence, the first discharge electrode 26 is interposed between the electrically conductive plates 32 and 33 serving as the positive and negative, left and right counter electrodes, respectively, and the positive and negative discharging actions are effectively combined, producing corona discharge with high efficiency.

As a consequence, the high voltage (e.g. −7,000 V to −10,000 V) introduced into the ground line 16 through each of the holding ground electrode plates 7 and 8, serving as a connection means for connection to the human body as the charged object, as well as through the chain 10, is reduced to a sufficiently low magnitude by corona discharge between the electrically conductive plates 32 and 33 working as the respective negative and positive, left and right counter electrodes. Thereafter, the charged voltage is received at the opposing ends of the Nichrome™ wire coil 23*b* of the heater 23, thereby causing discharging to some extent. Further, the current travelling in the Nichrome™ wire coil 23*b* is consumed as Joule's heat in an extremely short period of time, whereby it is rapidly reduced by corona discharge between the iron ball 23*a* of the first discharge electrode 26 and the sleeve 26.

On the other hand, as shown in the drawings, the fourth static electricity elimination device 70 includes a light-emitting diode 14 connected in parallel to a first arrestor 17 in the form of a Harrison discharge tube. Tube 17 is gas-filled and has its (+) side connected to the power line 15 through resistance R13 (100 kΩ) and its (−) side connected to the stainless steel sleeve 26b of the first discharge electrode 26 of the first static electricity elimination device 20 through the residual charge discharge wire 71. The residual charge discharge wire 71 is connected to the ground line 16 through resistance R3 (100 kΩ).

Therefore, the residual charges (charges put into the sleeve) left undischarged by the first discharge electrode 26 can be effectively discharged and eliminated by the light-emitting diode 14 and the first arrestor 17 through the residual charge discharging wire 71.

Figure 5:
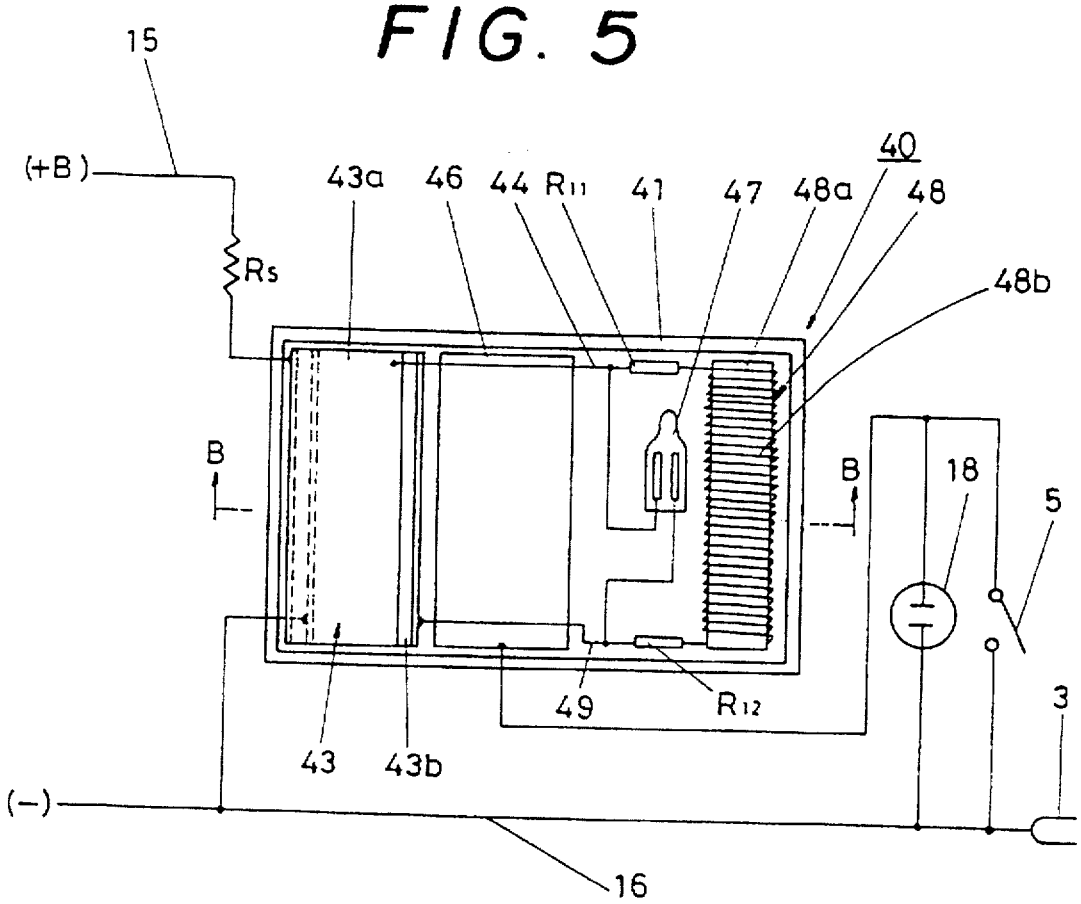
FIG. 5 is a view showing internal components of a second embodiment of the present invention.
Figure 6:
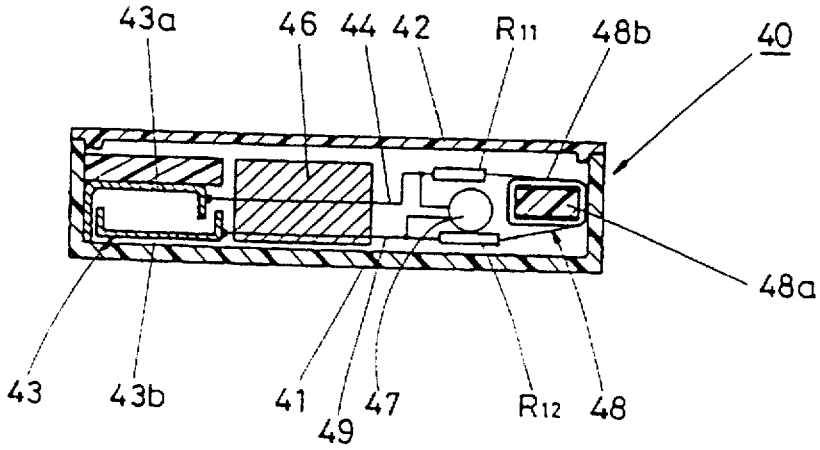
FIG. 6 is a sectional view taken along line B—B of FIG. 5.

A second embodiment is shown in FIGS. 5 and 6 as static electricity elimination device 40. In the drawings, reference numeral 41 denotes a box-shaped casing made of a non-electrically conductive synthetic resin and it is covered with a lid 42. In the casing 41, there are disposed a second heater 48 having a Nichrome™ wire coil 48b wound on an acrylic resin core 48a, a second arrestor 47 in the form of a Harrison discharge tube containing a gas capable of absorbing an electrostatic surge like the above first arrestor, a discharging plate 46 made from a copper plate block having a predetermined thickness, and a second discharge electrode 43. The second discharge electrode 43 is a pair of stainless steel negative and positive counter electrode plates 43a and 43b, each having a square C-shaped section and disposed facing each other with a predetermined spacing. The positive counter electrode plate 43a of the second discharging electrode 43 is connected to the second power supply line 15 through resistance R5 (1 kΩ) and the negative counter electrode plate 43b of the second discharge electrode 43 is connected to the second ground line 16. Further, a (+)-side terminal of the second heater 48 is connected to the positive counter electrode plate 43a of the second discharge electrode 43 through resistance R11 (100 kΩ) and a (−)-side terminal of the second heater 48 is connected to the negative counter electrode plate 43b of the second discharge electrode 43 through resistance R12 (100 kΩ). In addition, the second arrestor 47 is connected bridging the connection wires 44 and 49. The discharging plate 46 is connected to the ground line 16 through a third arrestor 18 in the form of a Harrison discharge tube filled with gas in the same manner as described hereinabove. The third arrestor 18 is connected in parallel with the short-circuit switch 5.

With the arrangement as described hereinabove, the charged voltage (e.g. −7,000 V to −10,000 V) applied to and introduced into the ground line 16 through each of the ground electrode plates 7, 8 and the chain 10, serving as a connection means for connecting to the human body, is applied to and discharged by the third arrestor 18 to thereby reduce its voltage. Further, the residual voltage is also applied to the wide discharge plate 46 composed of a copper plate block and discharged into the space within the casing. At the same time, the charged voltage is applied to the second discharge electrode 43 consisting of the positive and negative counter electrode plates 43a and 43b to cause a corona discharge between the positive counter electrode plate 43a and the negative counter electrode plate 43b, thereby neutralizing positive and negative ions and reducing the electrostatic voltage. In addition, the negative counter electrode plate 43b of the second discharge electrode 43 is connected to the (−)-side terminal of the Nichrome™ wire coil 48b of the second heater 48 through the resistance R12 and the positive counter electrode plate 43a is connected to the (+)-side terminal of the Nichrome™ wire coil 48b of the second heater 48. Between the two connection wires is connected the second arrestor 47. With the above arrangement, the residual charges left undischarged by the second discharge electrode 43 are discharged by the second arrestor 47 and by the Nichrome™ wire coil 48b of the second heater 48 as Joule's heat.

Figure 7:
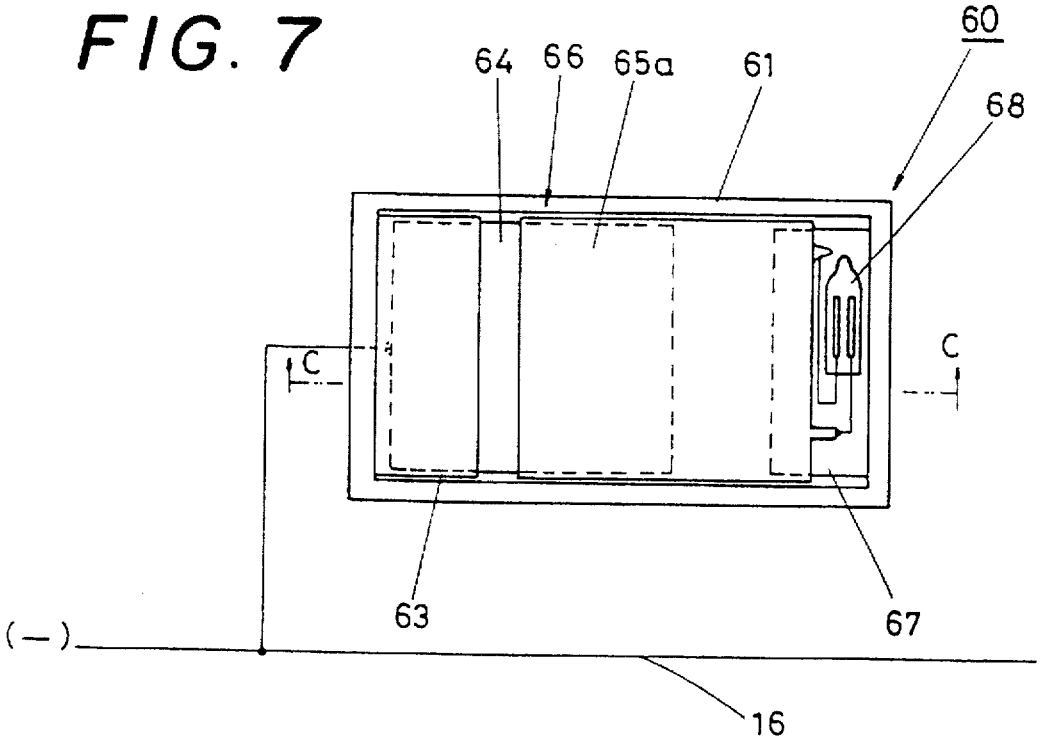
FIG. 7 is a view showing internal components of a static electricity eliminating device according to a third embodiment of the present invention.
Figure 8:
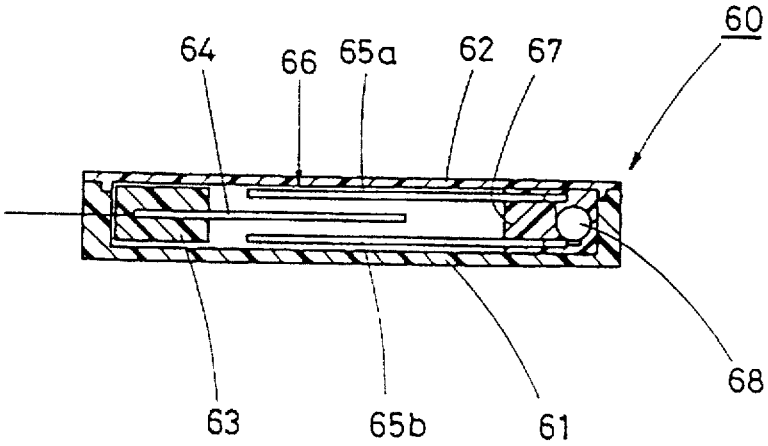
FIG. 8 is a sectional view taken along line C—C of FIG. 7.

FIGS. 7 and 8 show a static electricity elimination device 60 as a third embodiment wherein reference numeral 61 denotes a box-shaped casing made of a non-electrically conductive synthetic resin provided with a lid 62. In the casing 61 are disposed a first electrode plate 64 made of stainless steel, a third discharge electrode 66, and a fourth arrestor 68. The first electrode plate 64 is supported by and secured to a first support member 63 made of an acrylic resin and centrally located within the casing. The third discharge electrode 66 comprises a second discharge electrode plate 65a and a third discharge electrode plate 65b, each made of copper and supported by and secured to a second support member 67 made of an acrylic resin and are thus located above and under the first electrode plate 64, respectively. The fourth arrestor 68 is in the form of a Harrison discharge tube with filled with gas in the same manner as described hereinabove and is connected between the second and third electrode plates 65a and 65b of the third discharge electrode 66. The first stainless steel electrode plate 64 is connected to the ground line 16.

With the arrangement as described above, the charged voltage (e.g. −7,000 V to −10,000 V) introduced into the ground line 16 through each of the holding earth electrode plates 7, 8 and the chain 10 is applied to the first electrode plate 64 and discharged between the second and third electrode plates 65a and 65b, thereby allowing the negative charges to be transferred to the second and third electrode plates 65a and 65b. The negative charges transferred to the second and third electrode plates 65a and 65b are then discharged by the fourth arrestor 68 to a sufficiently low level.

Figure 9:
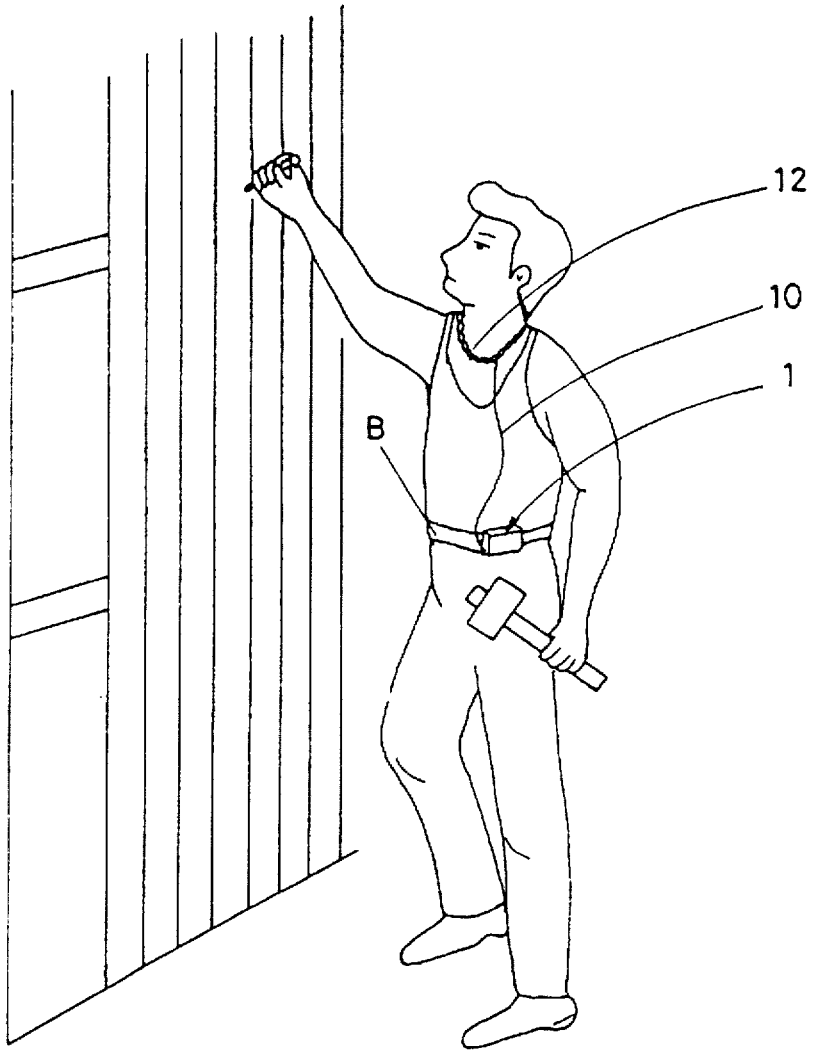
FIG. 9 is a schematic view illustrating one usage of the static eliminator of the first embodiment of the present invention.
Figure 10:
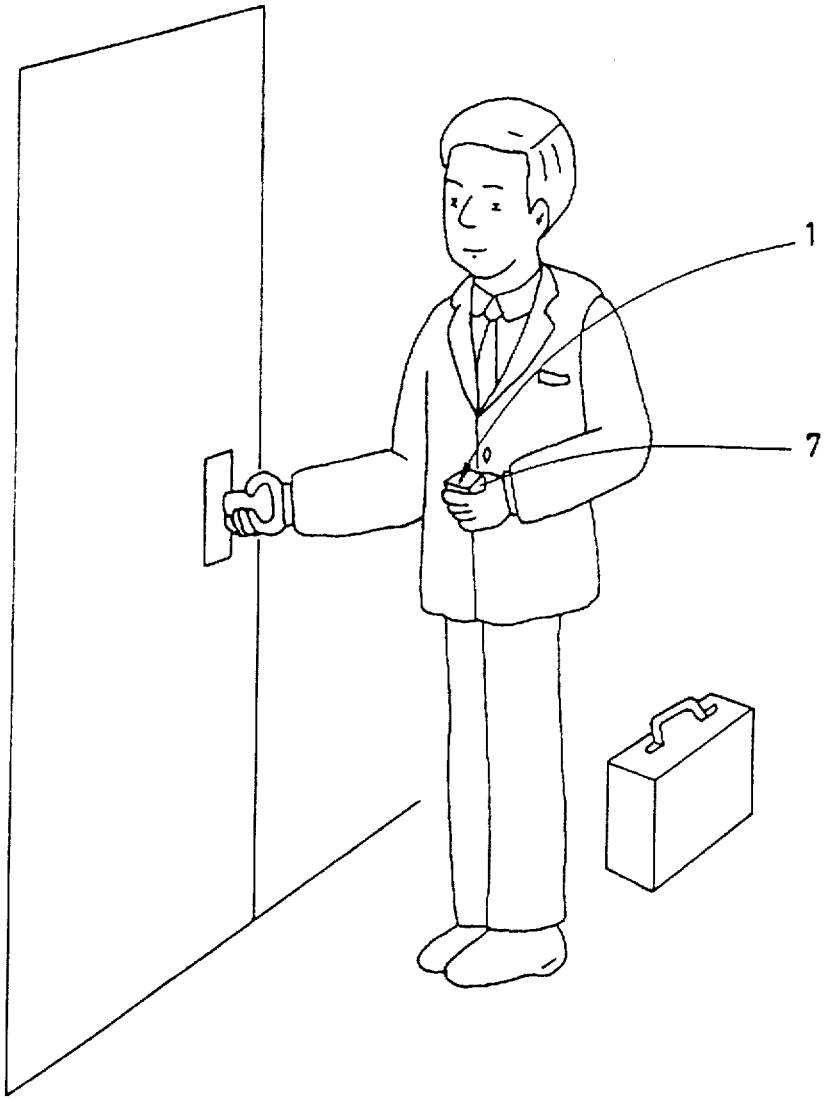
FIG. 10 is a schematic view illustrating a second use of the static eliminator according to the first embodiment of the present invention.

The static eliminator having the configuration as described can be carried by a person at work, for example, as shown in FIG. 9, with the housing 1 is fixed to a belt around the waist of the user and the necklace portion 12 of the chain 10 connected at the ground plug socket 3 worn around the neck. Alternatively, as shown in FIG. 10, the housing 1 is carried in the hand of the user. With the above arrangement, the human body may be connected to the ground line 16 of the static eliminator through the chain 10 with the necklace portion 12 working as the connection means to the ground line 16 or to the holding ground electrode plates 7 and 8. In this manner static electricity on the human body, charged at a voltage as high as, for example, −7,000 V to 10,000 V, can be fed to and discharged by the electrically conductive plates 32 and 33, serving as positive and negative counter electrodes through the ground line 16, the first heater 23, the first static electricity elimination device 20 consisting of the first discharge electrode 26, etc., the second heater 48, the second discharge electrode 43, the discharge plate 46, the second static electricity elimination device 40 consisting of the second arrestor 47, etc., the third static electricity elimination device 60 consisting of the third discharge electrode 66 and the fourth static electricity elimination device 70 consisting of the light-emitting diode 14 and the first arrestor 17, and the third arrestor 18. When the electrostatic electricity is discharged, particularly by the first and second static electricity elimination devices 20 and 40, the heaters 23 and 48 generate heat warning the temperature of air around the first and second discharge electrodes 26 and 43 to an appropriate level. As a consequence, the ion charges are caused to actively move, thereby accelerating the discharging action and rapidly releasing the charges from the human body.

Accordingly, the static eliminator according to the present invention can provide the same grounding effects as a wire connected with the ground, even through the static eliminator itself is not connected directly with the ground.

Furthermore, when the static eliminator according to the present invention is applied to electrical and electronic equipment, the problems caused by static electricity can be prevented without actual connection with the ground. In addition, there is no fear at all that a breaker will fail. Accordingly, the use of the static eliminator serves as an extremely effective means for preventing static electricity from causing problems.

EXPERIMENTAL EXAMPLES

(Example 1)

Figure 11:
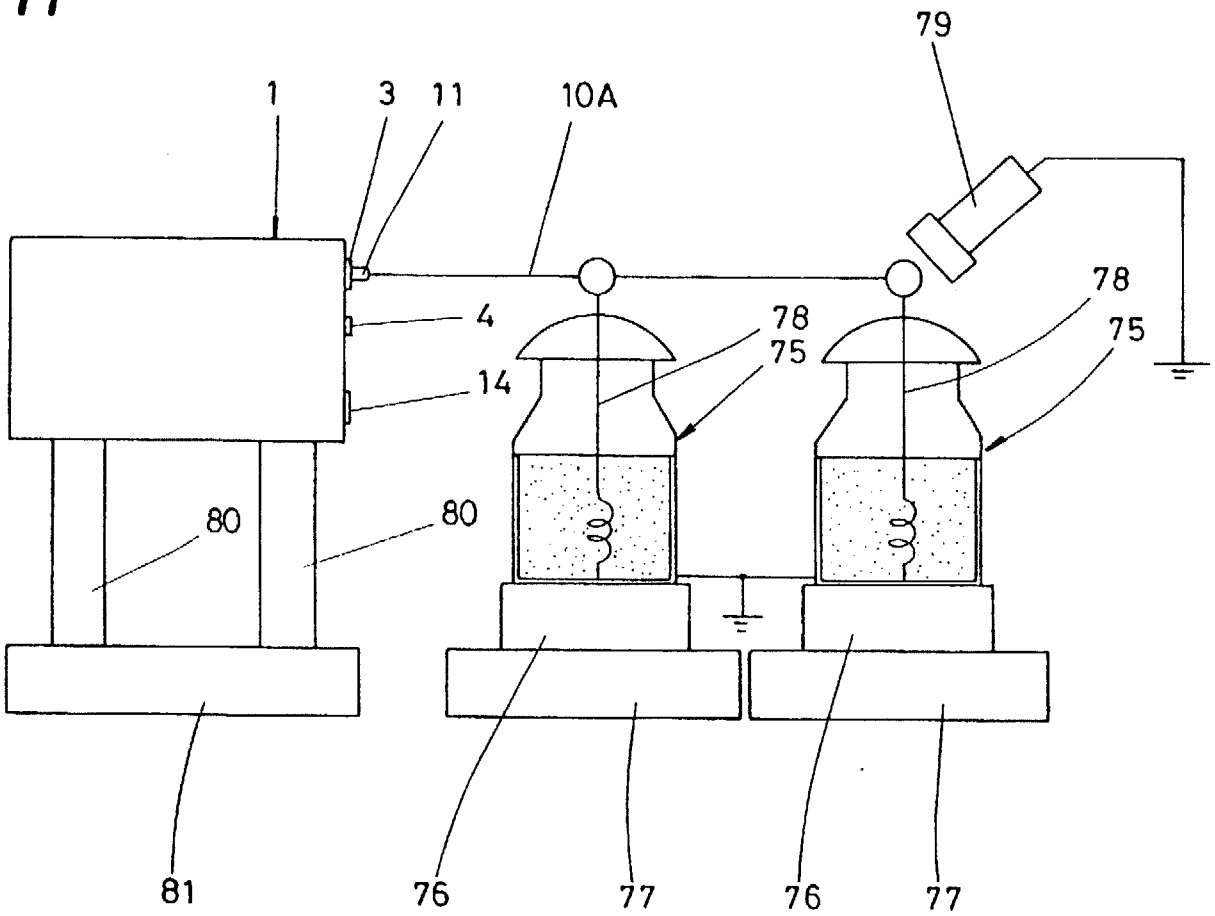
FIG. 11 is a schematic view showing the configuration of an experimental device for demonstrating the effect of absorption of static electricity achieved by the static eliminator according to the first embodiment of the present invention.

In an experiment, as shown in FIG. 11, two Leyden jars 75 and 75 were placed on insulating tables 77 through glass plates 76, respectively. Housing 1 of the static eliminator was placed on an insulating table 81 supported by two glass columns 80 in order to elevate it high above the ground. The Leyden jars 75 were each charged to a potential as high as (–)7,000 V by a Van de Graaff electrostatic generator. The ground plug socket 3 of the static eliminator was connected to electrodes 78 of the respective Leyden jars 75 through ground wire 10A, thereby discharging accumulated charges having a potential of (–) 7,000 V within the Leyden jars 75 and 75. The potentials of the electrodes were measured by an electrometer 79 fifteen times every ten seconds to periodically determine decrease of the electrode potential (experiment a).

On the other hand, each of the Leyden jars 75 was charged to (–)7,000 V and subjected to spontaneous discharging without connection to the static eliminator according to this embodiment. Periodic variation in the potential of the electrode was measured fifteen times every ten seconds in the same manner as in experiment a above (experiment b).

Figure 12:
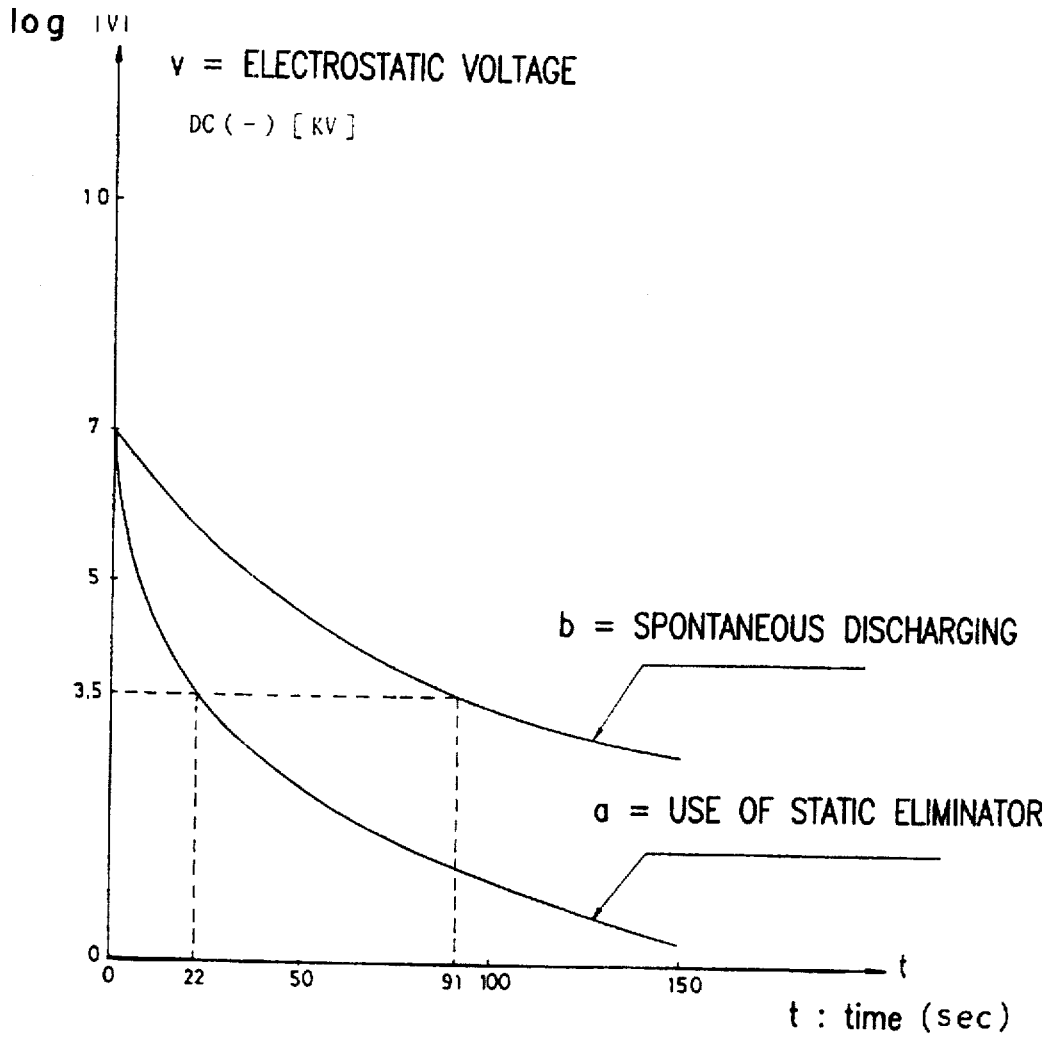
FIG. 12 is a graph of electrostatic voltage versus time illustrating the effect of a periodic decrease in static electricity, on the basis of the experimental results obtained with the experimental device as shown in FIG. 11.

The results of measurement in the experiments a and b are shown by the graph of FIG. 12. As is apparent from FIG. 12, the time required for reducing the original electrostatic potential by a half is shortened from 91 seconds to 22 seconds when the static eliminator according to this invention was employed (in experiment a) as compared with when no static eliminator was employed and the electrostatic potential was spontaneously discharged (in experiment b). From the results, it is seen that the discharging performance achieved by the static eliminator according to the present invention is more than four times that achieved by spontaneous discharge.

General speaking, no discharge would be caused by a potential as high as (–)3,000 V to (–)3,500 V, at which voltages there would be no electrical shock to the human body.

Figure 13:
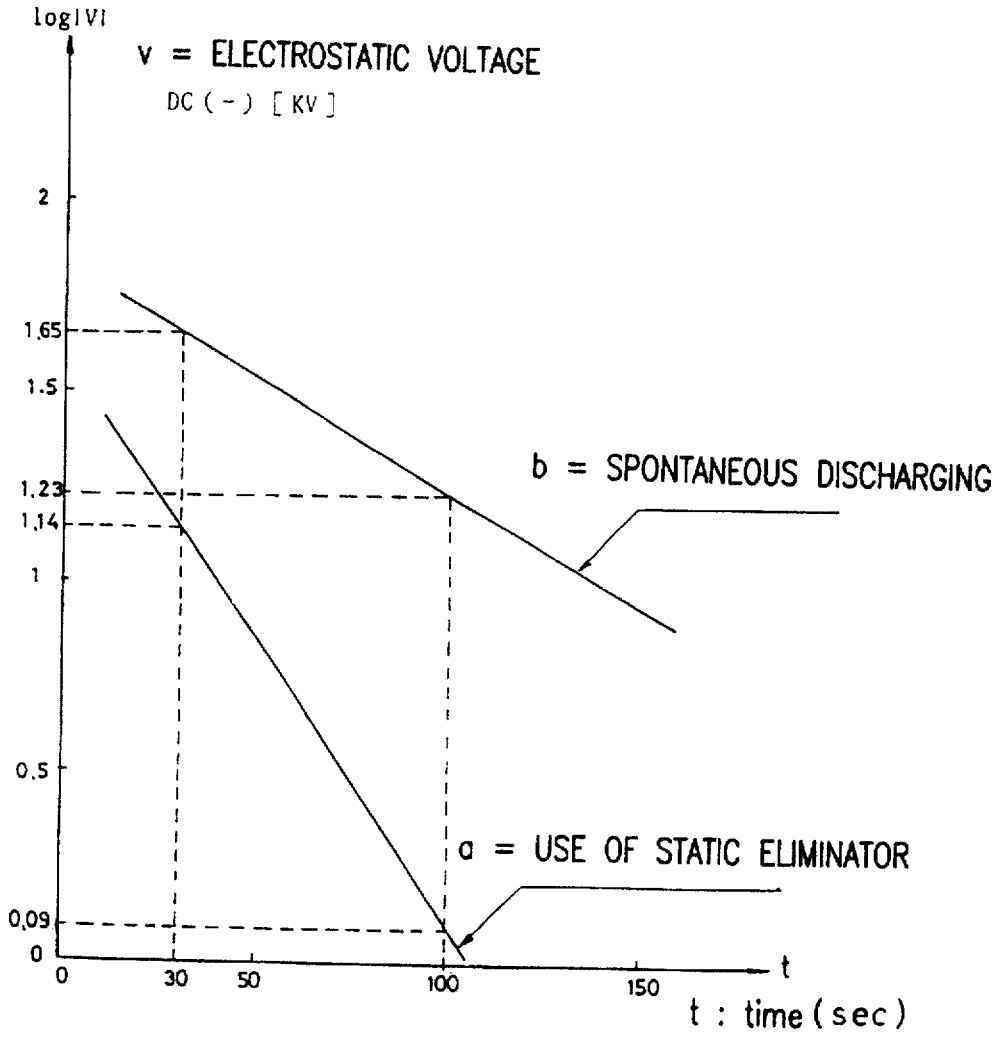
FIG. 13 is a graph of electrostatic voltage versus time and showing a static electricity attenuation factor characteristic, based on the experimental results obtained with the experimental device as shown in FIG. 11.

Further, the high discharging performance of the static eliminator according to this invention is also substantiated by graphs (a) and (b) of FIG. 13 wherein the attenuation factors of the electrostatic voltage in the experiments a and b were characterized and compared with each other (a=attenuation factor, 0.015, and b=attenuation factor, 0.006).

Figure 14:
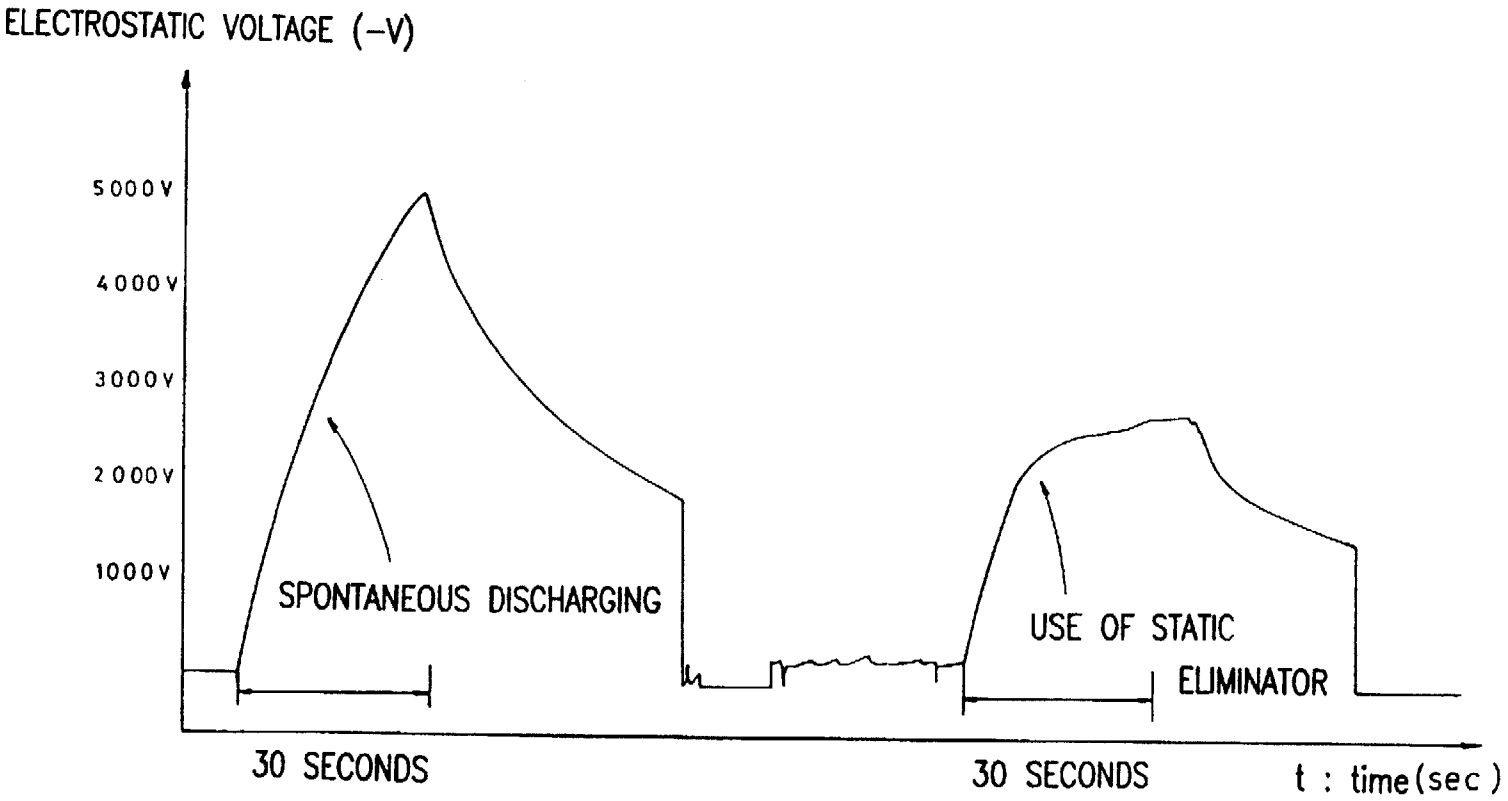
FIG. 14 is a graph of electrostatic voltage versus time and illustrating the wave-form of the static electricity obtained in experiment with the experimental device of FIG. 11, with recordation of static electricity by a pen recorder while varying settings of charging level, illustrating use of the static eliminator according to the first embodiment of the present invention.

FIG. 14 shows the results of measurement recorded by a pen recorder when the Leyden jars 75 and 75 were each charged to a potential as high as (–)5,000 V in substantially the same manner as the experimental method described hereinabove. It is understood from a comparison of data that the effect upon absorption of static electricity is remarkably high when the static eliminator according to the embodiment of the present invention is employed.

It is to be noted that, although in the above experimental method the ground line 10A was connected after the Leyden jars 75 and 75 were charged, each to a potential as high as (–)7,000 V, it is possible to charge the Leyden jars 75 with the ground line 10A already connected to the electrodes 78 of the Leyden jars 75, respectively, if power supply switch 4 of the static eliminator is turned off. In this case, simply by turning on the power supply switch 4 after completion of charging, the same experiment as described hereinabove can be easily repeated.

(Example 2)

Figure 15:
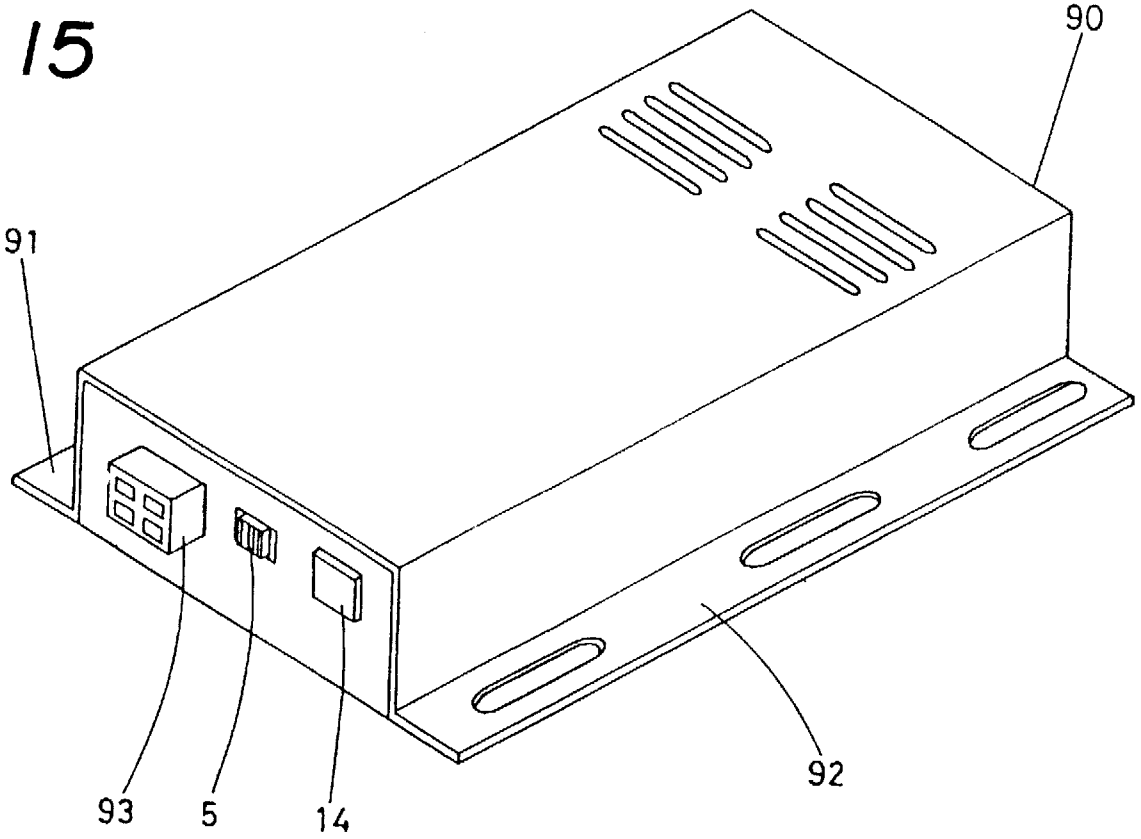
FIG. 15 is a perspective view of a housing of a static eliminator according to a fourth embodiment of the present invention.
Figure 16:
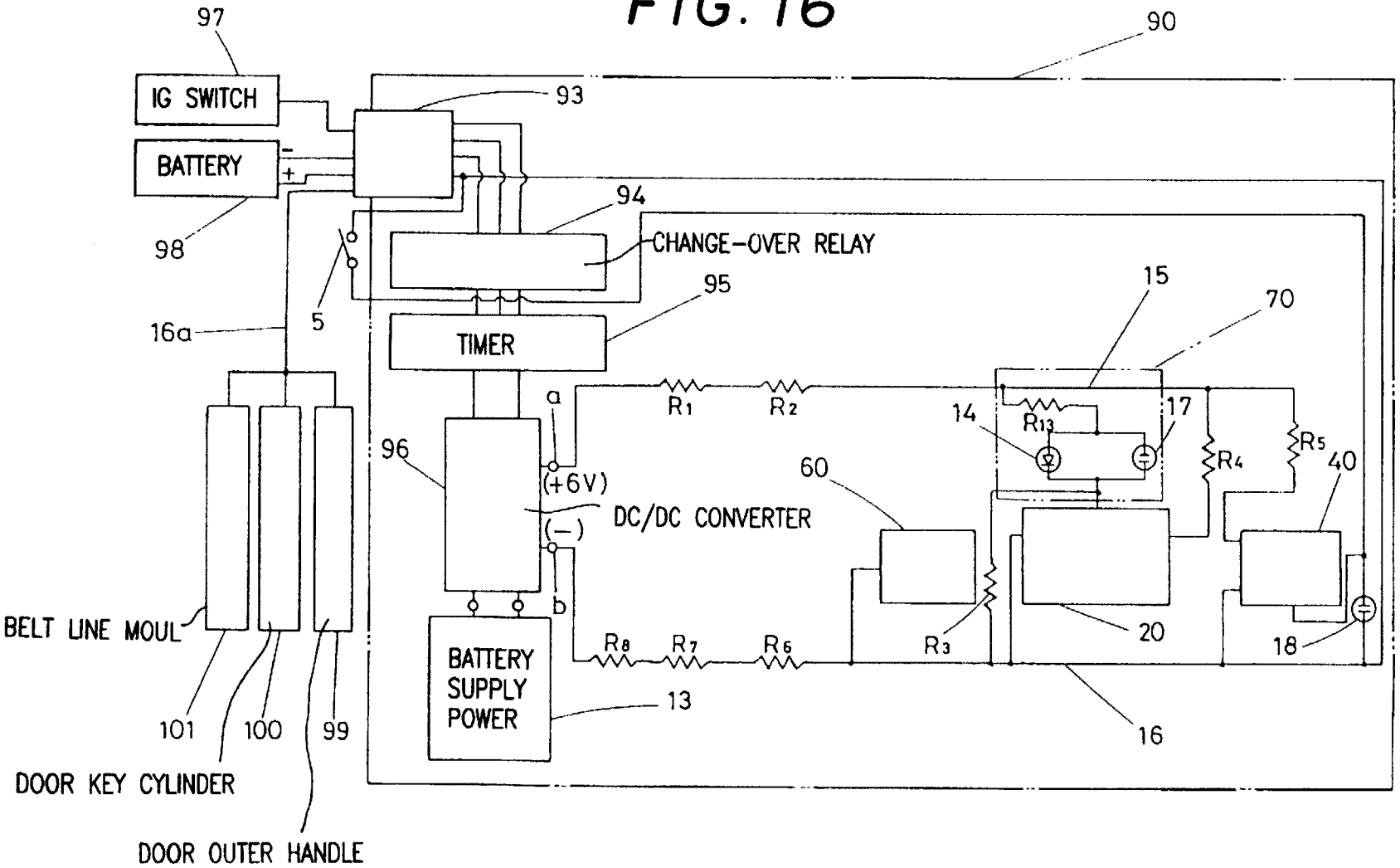
FIG. 16 is a wiring diagram showing the configuration of the electrical circuit of the static eliminator according to the fourth embodiment of the present invention.
Figure 17:
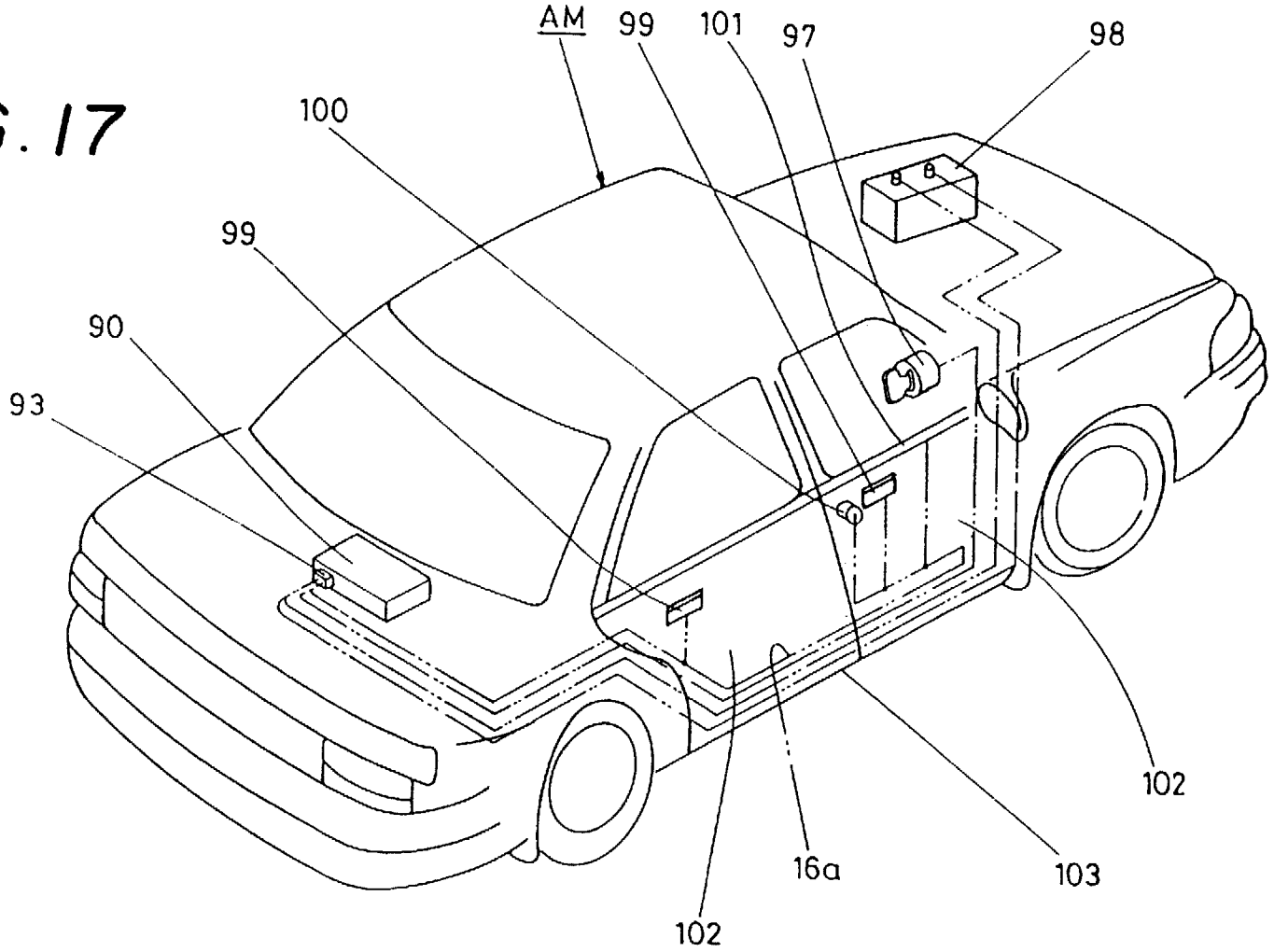
FIG. 17 is a perspective view showing a static eliminator according to the fourth embodiment of the present invention applied to the body of a car.

FIGS. 15 to 18 show an embodiment of the static eliminator according to the present invention mounted on a car. Turning first to FIG. 15, showing the housing 90 of the static eliminator mounted on the car, the housing 90 is shown as provided with mounting edge portions 91 and 92 suitable for mounting in the trunk of the car as shown in FIG. 17. On one end of the housing is disposed a connecter (a wire-harness coupler) 93 having a four-terminal structure, an electrical field line short-circuit switch 5, and a light-emitting diode 14, each projecting therefrom.

Inside the housing, are mounted in an appropriate arrangement a variety of electrical and electronic parts and wiring constituting a static electricity elimination circuit, for example, as shown in FIG. 16.

As shown in FIG. 16, the static electricity elimination circuit is basically the same configuration as the circuit according to the first embodiment of the present invention as shown in FIG. 2 but its power supply circuit portion has a somewhat different configuration because it is operated off of the car's battery 98 of (+)12 V. Thus, in this embodiment, battery power supply 13 has a rated voltage of (+)7.2 V and is chargeable by the car-loaded battery 98 and is connected to a battery terminal on the side of the connecter 93 and to power supply terminals +a and –b on the side of the static electricity elimination circuit through a DC/DC converter (12V→6V) 96. Between the DC/DC converter 96 and the connecter 93 are interposed a timer 95 serving as a switch and a change-over relay 94 serving to switch the timer ON or OFF.

The DC/DC converter 96 lowers the power supply input (12V) from the car battery 98 to +6V and supplies it to the battery power unit 13 and the power supply input terminals +a and –b of the electricity elimination circuit. The change-over relay 94 supplies the power supply voltage (+6V) to the static electricity elimination circuit by connecting the car-loaded battery 98 to the DC/DC converter 96 by turning the timer 95 ON for one minute beginning when the ignition key switch 97 of the car is turned OFF. The supply of the power voltage is blocked when the timer 95 has been turned OFF after one minute has lapsed.

Figure 18:
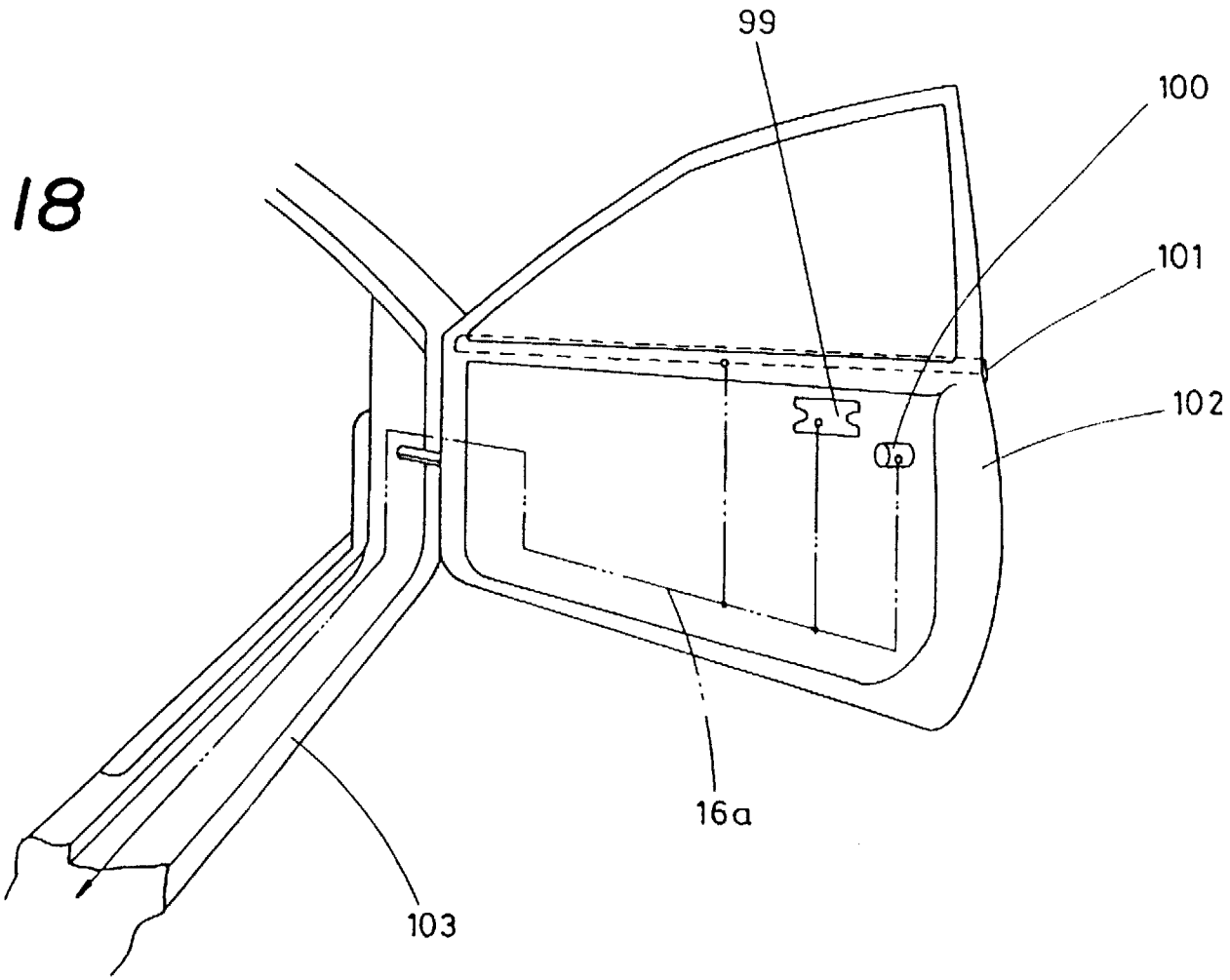
FIG. 18 is an enlarged perspective view showing an essential portion of FIG. 17.

The ground line 16 of the static electricity elimination circuit extends from a ground terminal of the connecter 93. The extension portion 16*a* is connected to each of door outer handles 99 of doors 102, a door key cylinder 100 and a belt line molding 101 of the car AM, as shown in FIGS. 17 and 18.

With the arrangement as described hereinabove, the static eliminator can absorb and lower the static electricity, for example, as the car body 103 has friction with air during travel, charging to (−)7,000 V to 10,000 V.

When a car stops travelling, the ignition key switch (IG-SW) 97 is usually turned OFF. As the ignition key switch is turned OFF, the changeover relay 94 operates to turn the timer 94 ON for one minute, thereby converting the power supply voltage (12V) from the car-loaded battery 98 into +6V by the DC/DC converter 96 and then supplying it to the power supply input terminals +a and −b of the static electricity elimination circuit.

As a consequence, the static electricity elimination circuit is equivalent in effect to the circuit as shown in FIG. 2, i.e. the first embodiment of the present invention, thereby rapidly lowering the charged potential to a potential lower than the discharge potential at the door outer handle 99, the door key cylinder 100 and the belt line molding 101, each being most likely to give an electrical shock to the human body, by the aid of the first through fourth static electricity elimination devices and the static electricity elimination function of the third arrestor 18.

Therefore, at the moment a driver opens the door 102, gets out of the car and touches the door 102 while standing on the ground after the ignition key switch 97 has been turned OFF, the static electricity previously gathered by the car has already been reduced to such an extent to no longer cause any discharge or a perceptible or unpleasant electrical shock.

Further, the timer 95 is automatically disconnected, as the time set for one minute has elapsed, and blocks the supply of the power to the static electricity elimination circuit from the car-loaded battery 98. Therefore, the electric power of the car-loaded battery 98 is not consumed to an unnecessary extent.

(Example 3)

Figure 19:
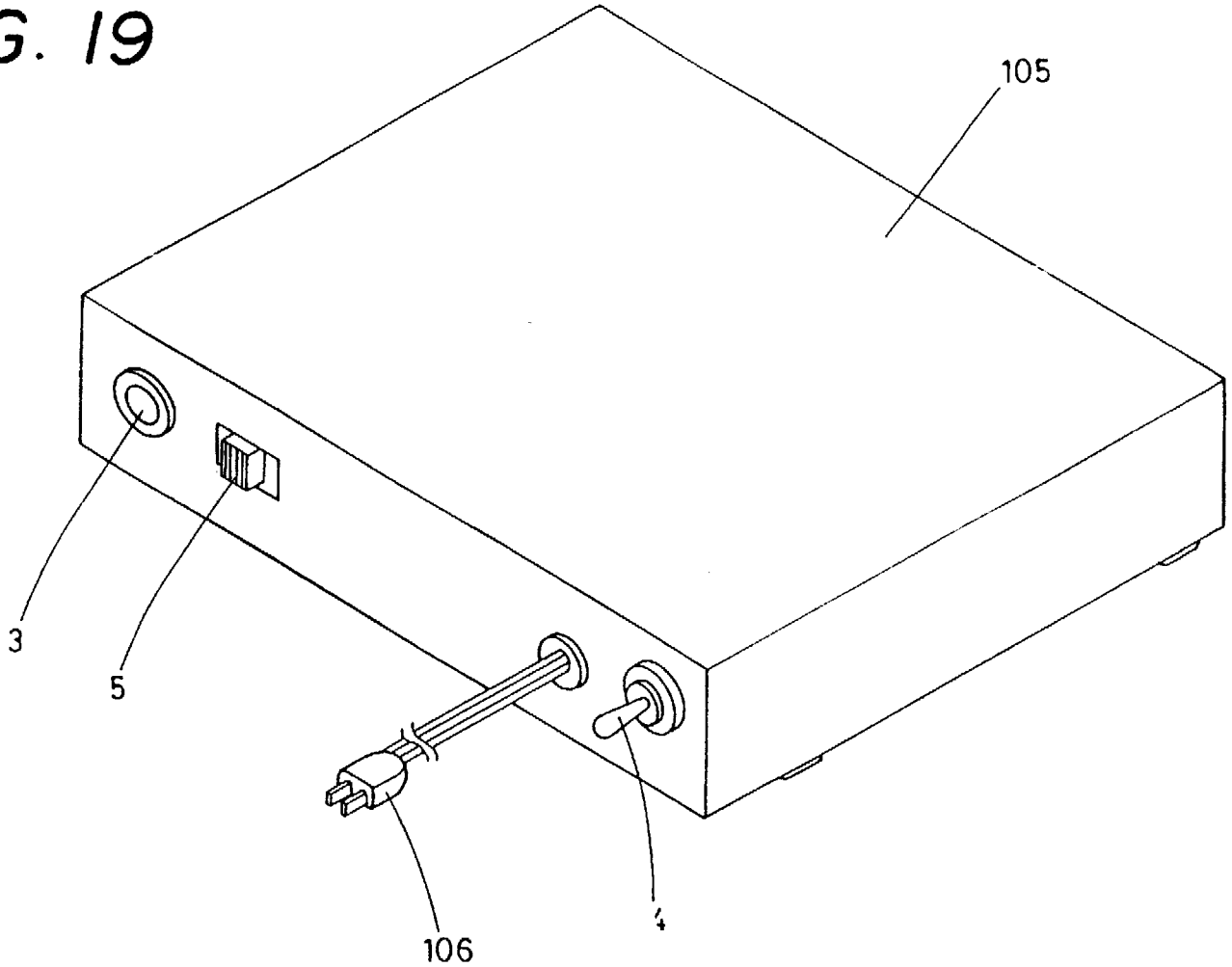
FIG. 19 is a perspective view of a housing of a static eliminator according to a fifth embodiment of the present invention.
Figure 20:
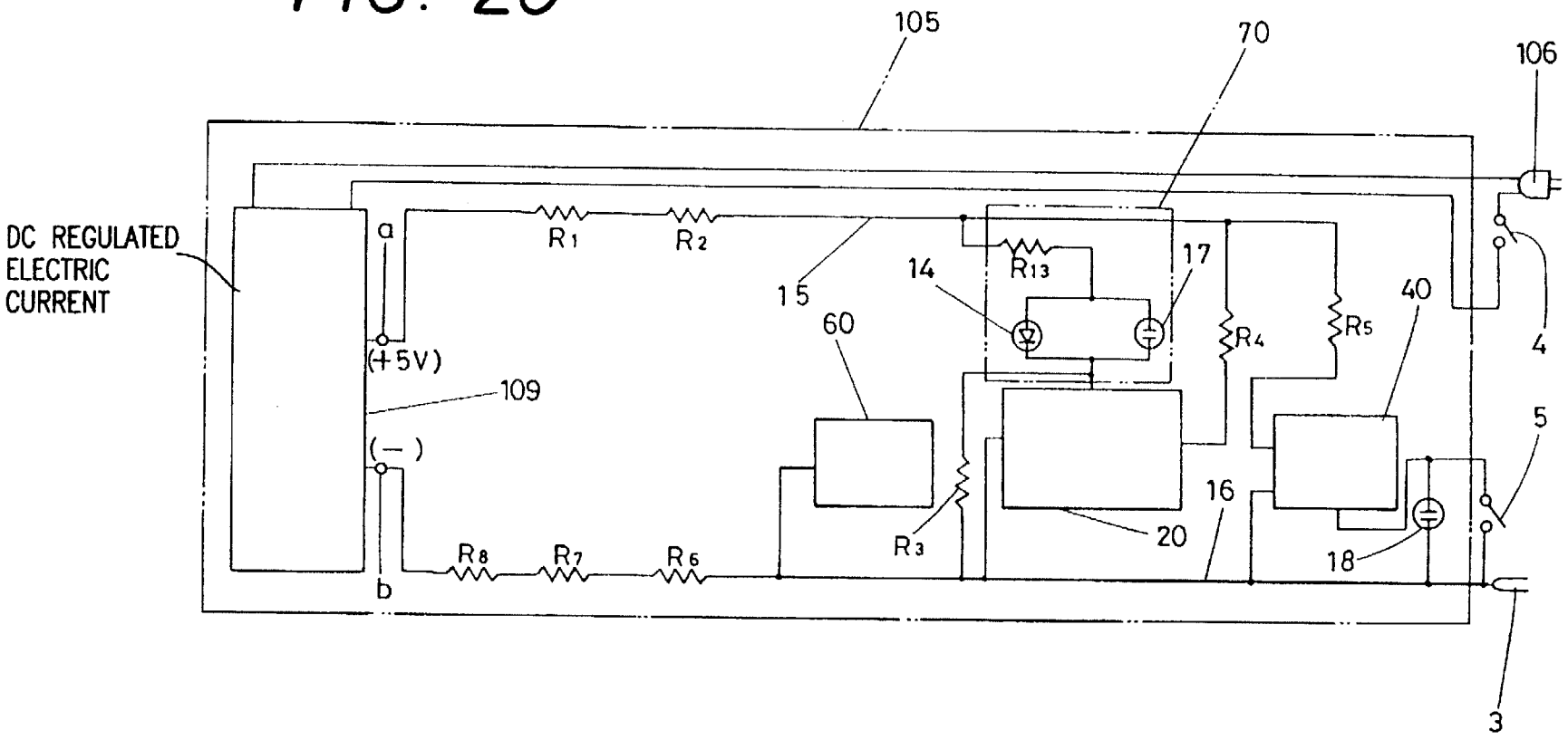
FIG. 20 is a circuit diagram of the fifth embodiment of the present invention.
Figure 21:
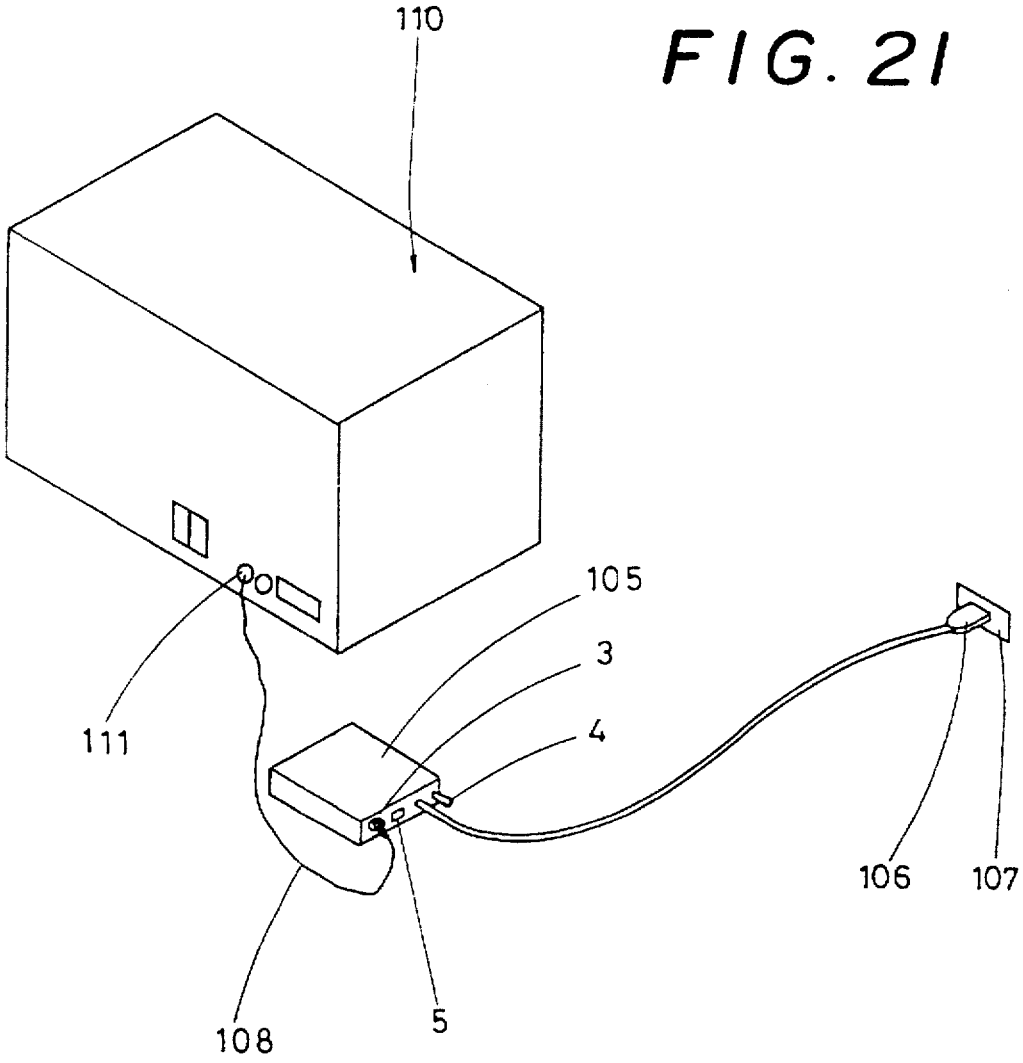
FIG. 21 is a perspective view illustrating use of the static eliminator according to the fifth embodiment of the present invention.

FIGS. 19 to 21 show the configuration of an embodiment of the static eliminator adapted for use with general electrical and electronic equipment. FIG. 19 shows a portion of a housing 105 of the static eliminator according to this embodiment of the present invention. On a front side portion of the housing 105 are disposed an earth plug socket 3, an electrical field line short-circuit switch 5, a power supply switch 4 and an AC power plug 10, in a manner similar to the first embodiment of the present invention.

Inside the housing 105 are a variety of electrical and electronic parts and wiring constituting the static electricity elimination circuit, for example, as shown in FIG. 20.

The static electricity elimination circuit is substantially the same configuration as the circuit of the first embodiment of the present invention, as shown in FIG. 2. However, in this embodiment, there is employed a DC regulated power supply 109 (+5 V) with an AC/DC converter which differs from a portable embodiment because the AC power supply is used.

The DC regulated supply power 109 is connected to the AC power supply 107 through an AC power supply plug 106 in substantially the same manner as in FIG. 21.

The ground line 16 is connected from the ground plug socket 3, through a ground wire 108 for eliminating static electricity, to a ground terminal 111 of an electrical or electronic device 110 readily susceptible to becoming charged, such as an electrostatic treatment device, an office automation machine, an electronic oven or the like.

With the above arrangement, the charge from the electrical or electronic device 110 is led through the ground wire 108 to the ground line 16 of the static electricity elimination circuit as shown in FIG. 20 and it is effectively removed by discharge and neutralization of positive and negative ions in the electrical field by each of the first through fourth static electricity elimination devices 20, 40, 60 and 70 as well as the first arrestor 17, in substantially the same manner as in the first embodiment of the present invention.

Therefore, when the static eliminator according to this embodiment as shown in FIG. 21 is connected to the electrical or electronic device 110, the charge potential of the electrical or electronic device 110 can always be kept low to avoid electrical shock.

Comparative Example

Experimentation was carried out in order to compare the action of the static eliminator according to the foregoing embodiment with that of a wire connected with the ground. A first experiment investigated abnormality of an electrical device by discharging electricity (DC −20 KV) to the electrical device connected with ground.

A second experiment was carried out in substantially the same manner by connecting the static eliminator according to the present invention to the ground terminal of the electrical device and, at the same time, discharging static electricity (DC −20 KV).

However, when the static eliminator according to the present invention was not employed, an electrostatic voltmeter and a pen recorder which were connected with the ground during an experiment wherein a stainless steel box was charged at DC −20 KV and its electrostatic characteristics were being investigated, received a discharge by which both the electrostatic voltmeter and the pen recorder were broken.

On the other hand, even when the same experiment as described hereinabove was repeated six times with connection of a ground terminal of each of the electrostatic voltmeter and the pen recorder to the static eliminator according to the present invention, no abnormality was recognized in the electrostatic voltmeter and the pen recorder, even after discharging six times.

It is found from this experiment that the static eliminator according to the present invention alleviates the impact of electrostatic discharge and enhances the discharging to effectively prevent problems occurring in electrical equipment due to static electricity.

The merits and advantages of the static eliminator according to the present invention include:

(a) Failure and breakdown of electrical equipment can be prevented because the electrical equipment can be maintained at its optimum operating condition by removing static electricity.

(b) No tool for connection with the ground is necessarily required. Therefore, the static eliminator can be optimally applied to medical treatment devices which otherwise lower their performance by connection with the ground.

(c) In many occasions, problems have been caused by static electricity even when electrical and electronic equipment is connected with the ground. However, using the static eliminator according to the present invention, it becomes possible to minimize probability of problems caused by static electricity to the lowest extent.

(Example 4)

Figure 22:
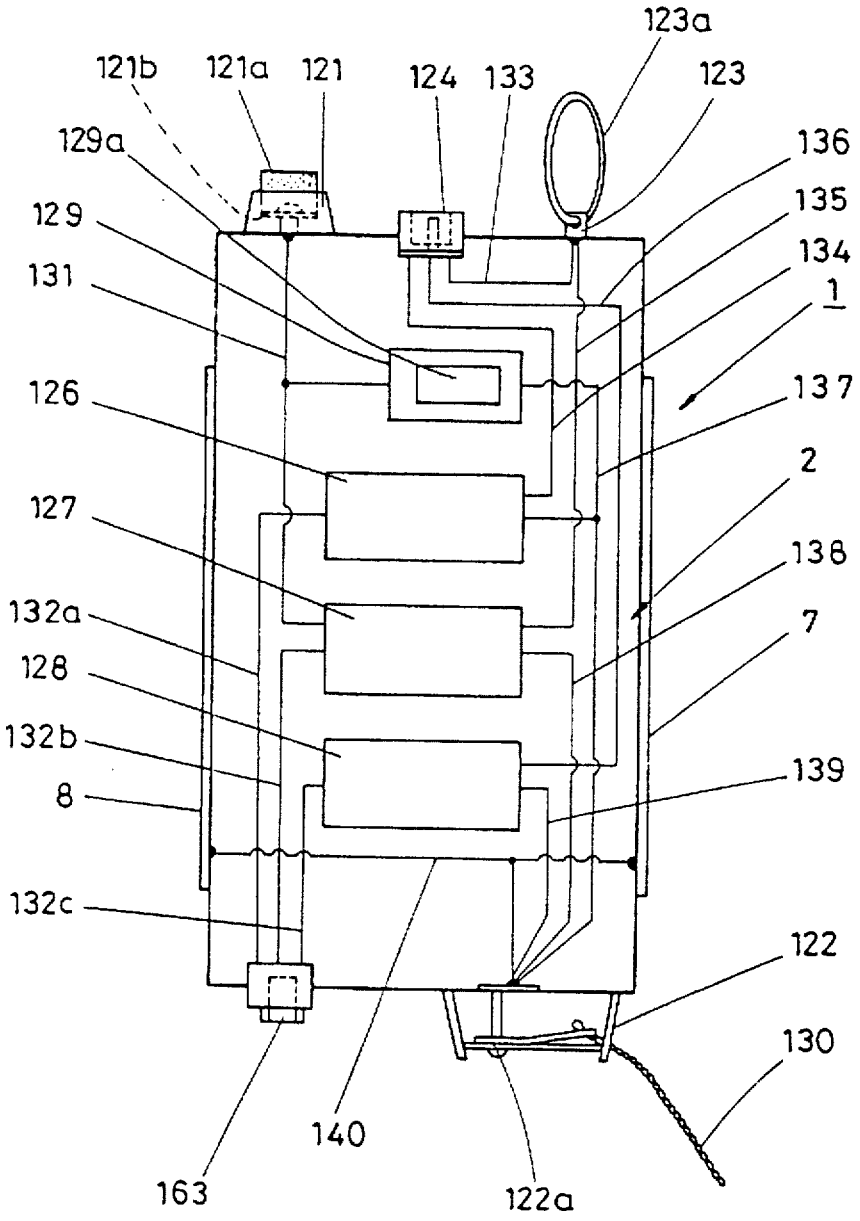
FIG. 22 is a perspective view of a housing and circuit wiring of a static eliminator according to a sixth embodiment of the present invention.

FIGS. 22 to 31 show a static eliminator according to a fourth embodiment of the present invention in which no battery power supply is utilized at all unlike the first embodiment of the present invention, but is a portable static eliminator for use with the human body in a manner similar to the first embodiment. As shown in FIG. 22 the portable static eliminator of this embodiment includes a housing 1 of a box shape having a size suitable for accommodation in a pocket or suitable for holding by hand, in a manner similar to the first embodiment of the present invention. The box-shaped housing 1 comprises a body section 2 having a predetermined depth and a lid (not shown) to be detachably attached to an open side of the body section 2. Inside the housing 1, are first through third static electricity elimination devices 126 through 128 and an electrostatic voltage display device 129 in an appropriate arrangement, as shown in FIGS. 23 to 30.

On the other hand, on an upper end portion 2*a* of the body section 2 of the box-shaped housing 1 are disposed an electrical field electrode plug 121 of a flush type, an electrical field electrode plug 123 of a key holder type, and a connection jack for connecting an object, which are spaced left to right at predetermined intervals.

The electrical field electrode plug 121 of a flush type is fixed on an electrode plate 121*b* connected to a first internal static electricity elimination line 131 and covering an urethane foam 121*a* through an electrically conductive rubber. By connection to the charged object through the urethane foam 121*a*, static electricity to be eliminated can be introduced into and applied to the first internal static electricity elimination line 131. The object connection jack 124 can be employed for insertion of a plug for an external wiring for connecting an object serving to connect the human body with the ground, such as a heel strap or the like, known in the art as means for connecting the human body with the ground. The electrical field electrode plug 123 of a key holder type is provided with a ring 123*a* for mounting a key holder and employed by mounting a key, for example, on a door or the body of a car.

On side portions 2*b* and 2*c* of the box-shaped housing 1 are disposed holding ground electrode plates 7 and 8 for connection of the human body to an internal ground line 140 in substantially the same manner as in Example 1.

Further, on a lower end surface 2*d* of the box-shaped housing 1 are disposed a static electricity elimination chain connection jack 163 for connecting a chain for eliminating static electricity and a ground chain connection section 122 having a ground chain connection substrate plate (stainless steel substrate plate) 122*a*.

The chain connection jack 163 detachably receives a plug portion of the static electricity elimination chain made of a highly electrically conductive material such as gold, silver, copper or the like, having a necklace portion, for example, as a connection means for connecting the human body to each of the second through fourth static electricity elimination lines 132*a* through 132*c* of each of the first through third static electricity elimination devices 126 through 128, respectively.

The ground chain 130 is connected to the ground chain connection substrate plate 122*a* of the ground chain connection portion 122. The ground chain 130 is worn on and connected to the human body. The ground chain connection substrate plate 122*a* is connected in its inside to the ground line 140 and the first through third internal wires 137 through 139, respectively.

The first through third static electricity elimination devices 126 through 128, the electrical field electrode plug 121 of the flush type, the electrical field electrode plug 123 of the key holder type, the object connection jack 124 and the like are connected in the manner as will be described hereinafter.

First, an end of each of the first through third static electricity elimination devices 126 through 128, respectively, is connected to the static electricity elimination chain connection jack 163 through each of the second through fourth static electricity elimination lines 132*a* through 132*c*, respectively. On the other hand, the other end of each of the first through third static electricity elimination devices 126 through 128, respectively, is connected to the ground chain connection substrate plate 122*a* through each of the first through third internal wires 137 through 139 and further to the object connection jack 124 through each of the fourth through sixth internal wires 134 through 136. In this case, particularly the other end of the second static electricity elimination device 127 is connected to the object connection jack 124 from the fifth internal wire 134 through the electrical field electrode plug 123 of the flush type and through the seventh internal wire 133. In addition, the electrostatic potential display device 129 and the one end of the second static electricity elimination device 127 are connected to the electrical field electrode plug 121 of the flush type through the first static electricity elimination line 131.

The object connection jack 124 is connected to the electrical field electrode plug 123 of the key holder type through the seventh internal wire 133.

Furthermore, the other end of the electrostatic potential display device 129 is connected to the ground chain connection substrate plate 122*a* through the first internal wire 137.

Each of the first through third static electricity elimination devices 126 through 128 as well as the electrostatic potential display device 129 will now be described.

(Configuration of the first static electricity elimination device 126)

Figure 23:
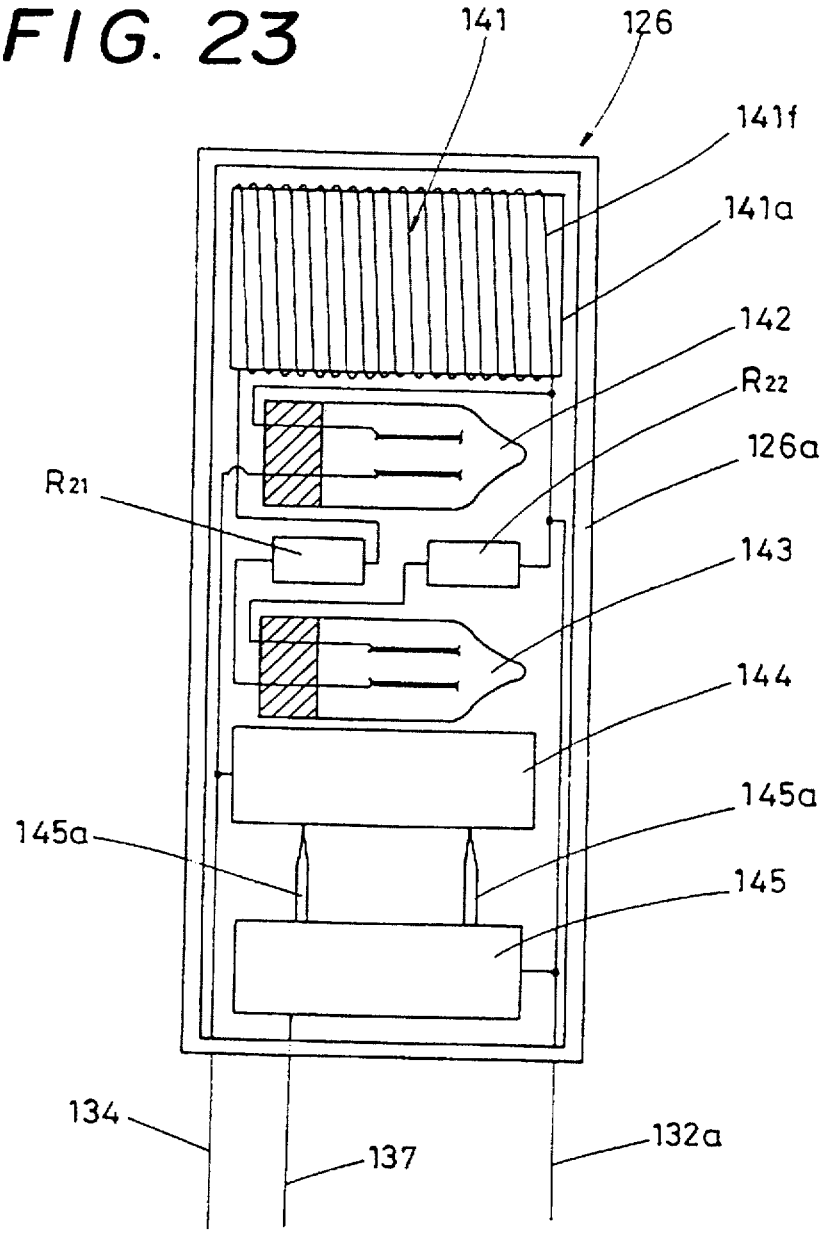
FIG. 23 is a plan view showing the static electricity eliminating device, with lid removed, according to the sixth embodiment of the present invention.
Figure 24:
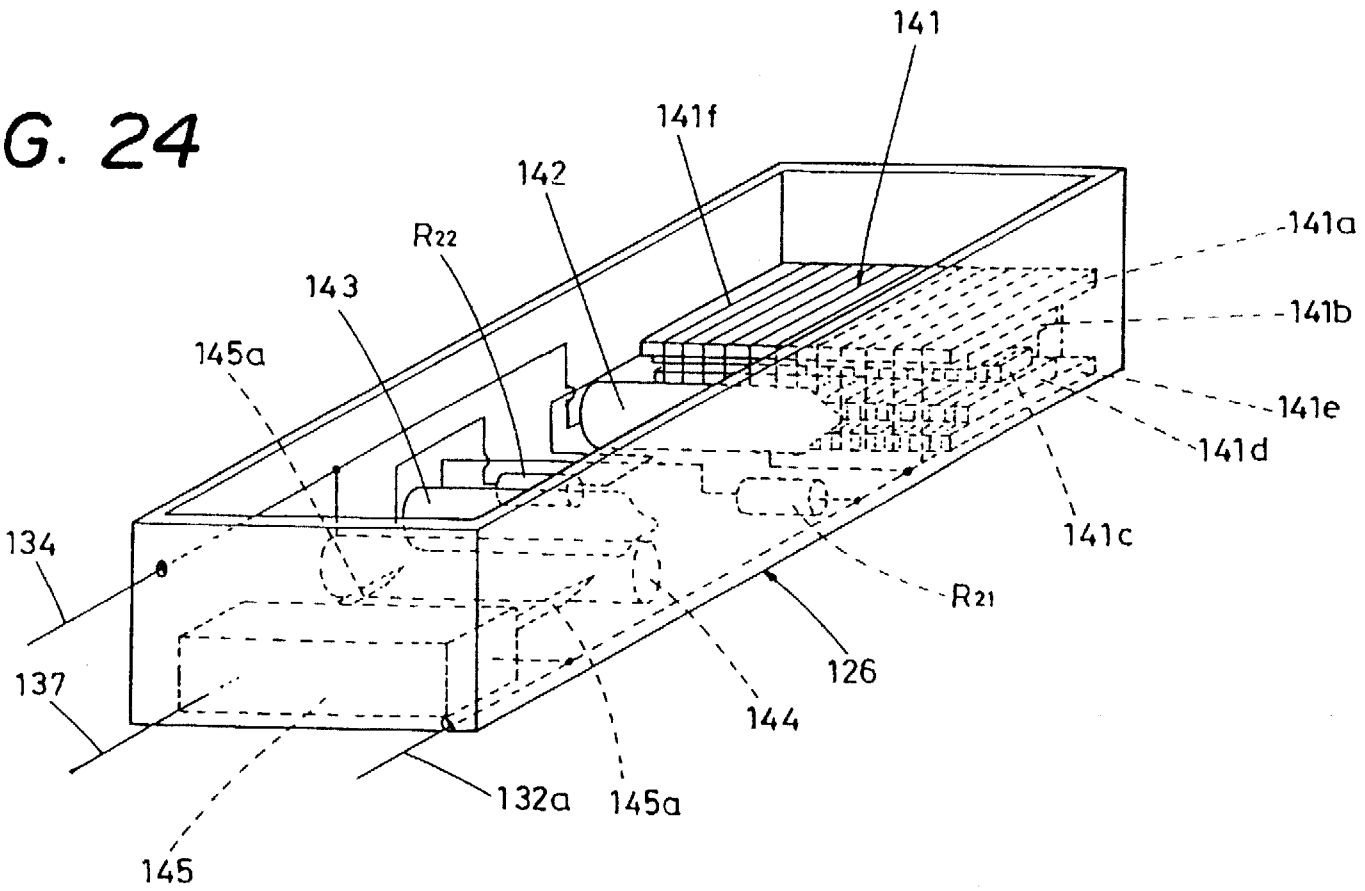
FIG. 24 is a perspective view of the static electricity eliminating device according to the sixth embodiment of the present invention.
Figure 25:
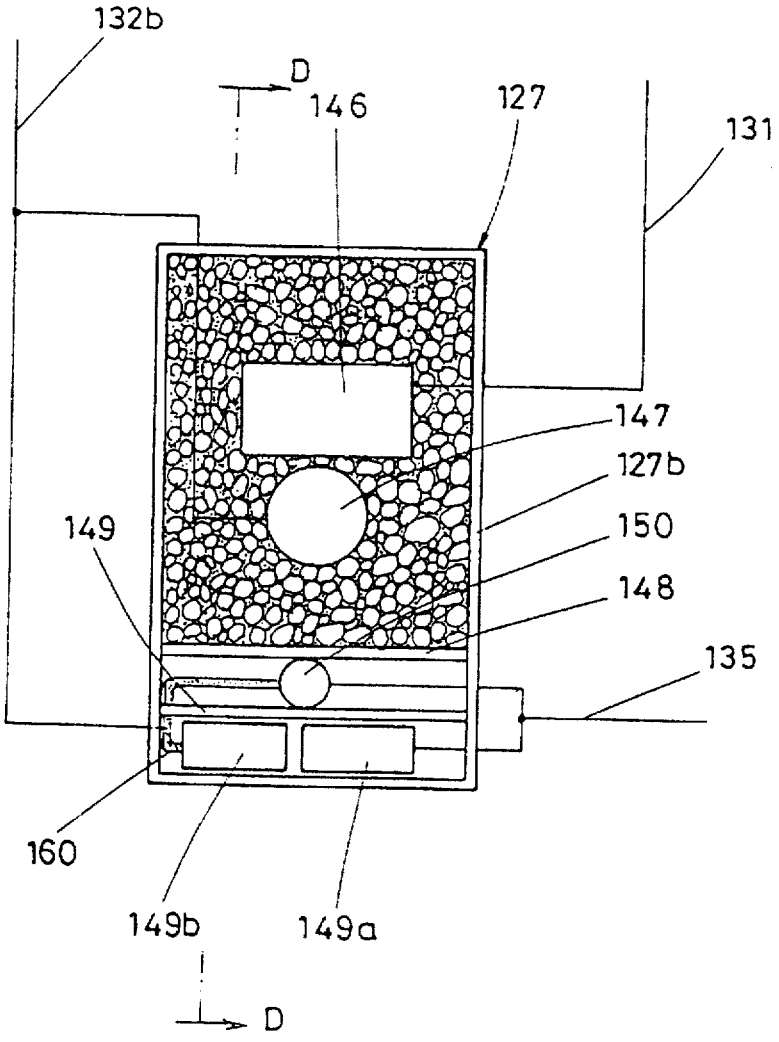
FIG. 25 is a plan view showing the configuration of a static electricity eliminating device, with lid removed, according to a seventh embodiment of the present invention.

FIGS. 23 and 24 show the first static electricity elimination device 126 as including a box-shaped casing 126 made of a non-electrically conductive synthetic resin provided with a lid (not shown). Inside the casing 126*a* are disposed a heater 141 of a multiple structure, a first arrestor 142 and a second arrestor 143, each in the form of a Harrison's discharge tube containing gases capable of absorbing an electrostatic surge, a first discharge plate 144 consisting of a iron string block having a predetermined diameter and length, a second discharge plate 145 consisting of a copper plate block having a predetermined thickness, and the like. The heater 141 is formed by winding Nichrome™ wire coils 141*f*, 141*f*, . . . , on each of cores 141*a* through 141*e* made of acrylic resin in multiple layers of varying sizes. A corona discharge electrode is formed as shown in the drawings by fixing two pin electrodes 145*a* and 145*b*, each made of iron, to the second discharge plate 145 so as to face the first discharge plate 144. One end of the second discharge plate 145 of the corona discharge electrode is connected to resistance R22 (30 kΩ), one end of the Nichrome™ wire coil 141*f* and the second static electricity elimination line 132*a*, while the other end of the second discharge plate 145 is connected to the first internal wire 137. Further, the other end of the first discharge plate 144 is connected to one end of the Nichrome™ wire coil 141*f* through the first arrestor 142 and to the fourth internal wire 134. The second arrestor 143 is connected to the second static electricity elimination line 132*a* and the other end of the Nichrome™ wire coil 141*f*, in series, through resistance R22 (30 kΩ) and resistance R23 (30 kΩ).

With the arrangement as described hereinabove, a charged voltage (e.g. −7,000 to −10,000 V) applied to and introduced into the static electricity elimination line 132*a* from the static electricity elimination chain, serving as a connection means for connecting to the human body, through jack 163 is applied to the first arrestor 142 and lowered by discharging. Thereafter, it is divided by a direct current circuit consisting of resistance R22, resistance R23 and the second arrestor 143 and consumed by discharging. In addition, residual static electricity was converted into heat by the heater 141 and thus consumed. Thereafter, any remaining static electricity is then discharged by the corona discharge electrode consisting of the first and second discharge plates 144 and 145 as well as the pin electrodes 145*a* and 145*a*. If the charged voltage is so high as to be incapable of being lowered by the three actions as described immediately hereinabove, the positive and negative ions are neutralized by corona discharge between the first discharge plate 144 and the pin electrodes 145*a* and 145*a* of the second discharge plate 145, thereby reducing and lowering the electrostatic voltage to a sufficiently low extent.

(Configuration of the second static electricity elimination device 127)

Further, FIGS. 25 to 28 show a second static electricity elimination device 127 as including a box-shaped casing 127*b* made of a non-electrically conductive synthetic resin and provided with a lid 127*a*. The casing 127*b* is divided into one large compartment and two smaller compartments by first and second partition walls 148 and 149, each made of a synthetic resin.

In the larger compartment on one side of the casing, a rectangular electrode 146 made of a copper material and a spherical electrode 147 made of an iron material are centrally disposed and fixed facing each other across a predetermined discharging gap and pumice and granitic earth 31 are filled around them.

The electrode 146 made of copper is connected to an input end of the first static electricity elimination line 131. The electrode 147 made of iron is connected to one end of the third static electricity elimination line 132.

In the smaller compartment in the middle, a spherical electrode 150 made of iron is disposed and fixed in a nearly central position. The iron electrode 150 is connected to one end of the fifth internal wire 135.

Further, in the smaller compartment at the other end, are disposed first and second neon electrodes 149*a* and 149*b*, each in a bar shape, so as to coaxially face each other across a predetermined discharging gap. The first neon electrode 149*a* on one end side is connected to the fifth internal wire 135 in substantially the same manner as the iron electrode 150 on the one end side. On the other hand, the second neon electrode 149 on the other end side is connected to the iron electrode 150 on the other end and a U-shaped Nichrome™ wire coil 160, as well as to the third static electricity elimination line 132 through the Nichrome™ wire coil 160.

Therefore, in the configuration as described immediately hereinabove, the static electricity from the charged object, introduced through the electrical field electrode plug 121 of the flush type or the static electricity elimination chain connection jack 163, and through each of the first and third static electricity elimination lines 131 and 132*b*, is applied to each of the copper electrode 146 and the iron electrode 147, causing corona discharge between the electrodes 146 and 147, and the ions so generated are effectively absorbed and neutralized by the pumice and granitic earth 31 around them.

On the other hand, one end of the iron electrode 150 having a smaller diameter and one end of the first neon electrode 149*a* are connected to a device for connecting the human body to ground through a fifth internal wire 135. Further, the other end of the iron electrode 150 having a smaller diameter and the other end of the first neon electrode 149*a* are connected to the Nichrome™ wire coil 160 for receiving the static electricity introduced from the third static electricity elimination line 132. The static electricity is first consumed as heat by the Nichrome™ wire coil 160 and discharged into the air around the iron electrode 150 having a smaller diameter. At the same time, a corona discharge is produced between the first and second neon electrodes 149*a* and 149*b*.

(Configuration of the third static electricity elimination device 128)

Figure 28:
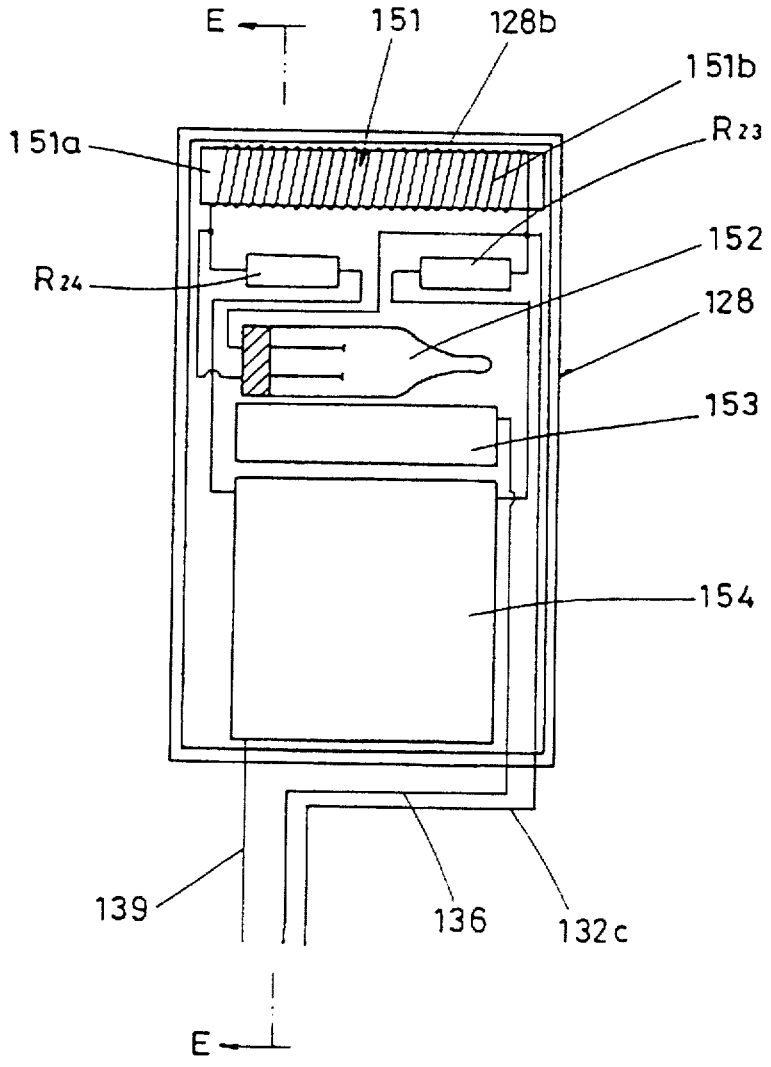
FIG. 28 is a plan view showing the configuration of static electricity eliminating device, with lid removed, according to an eighth embodiment of the present invention.

FIGS. 28 to 30 show a third static electricity elimination device 128 including a box-shaped casing 128*b* made of a non-electrically conductive synthetic resin provided with a lid 128*a*. In the casing 128*b*, are disposed a heater 151, an arrestor 152, a discharge plate 153 made from a copper plate block having a predetermined thickness, as well as a discharge electrode consisting of counter electrode plates 154 and 156, each in the form of a flat stainless steel plate, as shown in the drawings. The heater 151 is formed by Nichrome™ wire coil 151*b* wound on a core 151*a* made of an acrylic resin. The arrestor 152 is in the form of a Harrison discharge tube containing gases capable of absorbing an electrostatic surge. The discharge electrode is formed of counter electrode plates 154 and 156 disposed facing each other across a predetermined gap fixed with the aid of spacers 155 made of an acrylic resin. Further, the counter electrode plate 154 of the discharge electrode is connected to one end of the Nichrome™ wire coil 151 through resistance R24 and the counter electrode plate 156 is connected to the other end of the Nichrome™ wire coil 151 through resistance R23. The arrestor 152 is connected to both ends of the Nichrome™ wire coil 151*b* of the heater 151.

With the arrangement as described hereinabove, the charged voltage (e.g. −7,000 V to −10,000 V) introduced into the fourth static electricity elimination line 132, serving as a connection means for connection to the human body as a charged object, is discharged and lowered by the arrestor 152 and further consumed by the heater 151. Thereafter, the residual voltage is applied to the counter electrode plate 156 having a wide area through the resistance R23, and is subjected to corona discharge between the counter electrode plate 154 and the counter electrode plate 156, thereby causing the positive and negative ions to be neutralized and the electrostatic voltage to be reduced and lowered to a sufficiently low level. Further, corona discharge is caused to occur with the discharge plate 153 connected to the fifth internal wire 136 inside the object. In addition, the resistances R23 and R24 each have a resistance value of, for example, approximately 30 kΩ and serve to divide the static electricity into smaller portions and to lower the voltage. The discharge plate 153 is disposed so as to self-discharge (usually on the side of the means for connection with the ground), as static electricity is received through the sixth internal wire 136 inside the object. As a result, a sufficient amount of static electricity is eliminated.

The static eliminator according to this embodiment has both of the counter electrode plates 154 and 156 formed of a particularly wide area so as to readily discharge (dark discharge). Therefore, it can cope with a low level of electrostatic voltage if the discharging gap therebetween is sufficiently small. It can be said in this respect to be of a type suitable for a low electrostatic voltage.

(Configuration of the electrostatic potential display device 129)

Figure 31:
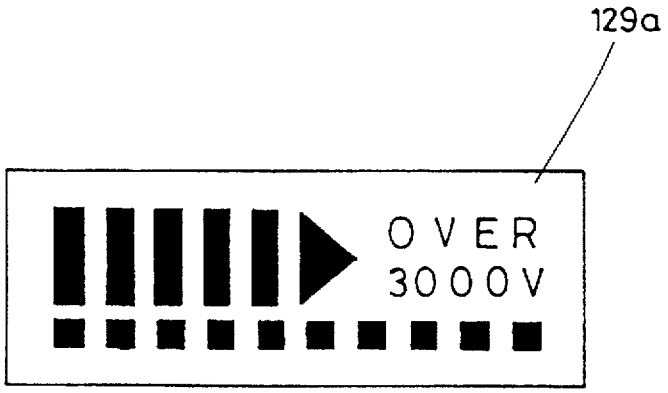
FIG. 31 is an example of a display of the static eliminator according to the eighth embodiment of the present invention.

FIG. 31 shows the configuration of a display section 129*a* of the electrostatic potential display device 129 as shown in FIG. 22 which is, for example, a liquid crystal display device. The display section 129*a* is configured in such a way that the words "OVER 3000 V are displayed as shown in the drawing when an electrostatic potential higher than DC −3,000 V is received by the first static electricity elimination line 131 and that this display automatically disappears when the electrostatic potential is lowered below that displayed level by the action for eliminating static electricity.

Further, the display can be arranged so as to display, for example, a specific figure for the electrostatic potential.

Experimental Example

In the embodiment as described immediately hereinabove, the first static electricity elimination device 126 is of a type capable of coping with a particularly high level of electrostatic voltage while the third static electricity elimination device 128 is of a type having elimination performance capable of coping with a relatively low level of electrostatic voltage and the second static electricity elimination device 127 is of a type performing at an intermediate level of electrostatic voltage. Therefore, the static eliminator according to this embodiment can deal with a wide range of voltages, ranging from high voltage to low voltage.

Figure 32:
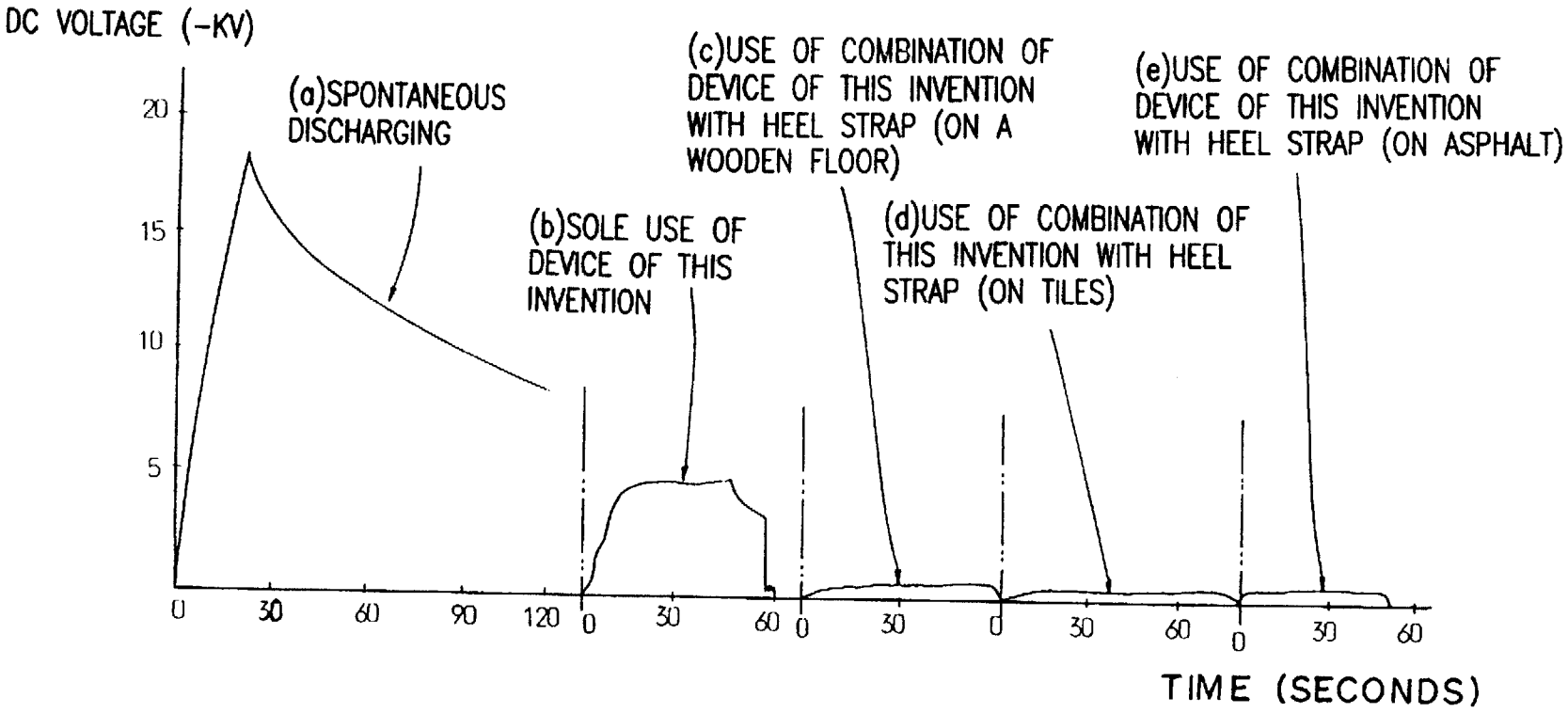
FIG. 32 is a graph showing the effect of periodic reduction in static electricity on the basis of the experimental results obtained using the experimental device of FIG. 11 for the static eliminator according to the eighth embodiment of the present invention.

FIG. 32 shows the results of measurement of effects for eliminating electricity achieved by the static eliminator according to this embodiment, in a manner similar to the first embodiment as shown in FIG. 14.

The measurement was carried out for a case (b) in which the static eliminator was solely employed and for each of cases (c) through (e) in which the object wiring was employed for connection to a heel strap at varying locations. As shown in the drawing, it was found that the effects of elimination of static electricity in the cases (c) through (e) are far better than a case (a) in which spontaneous discharge was caused.

Further, as compared to the case where the static eliminator was solely employed, it is found that the connection of the object connection jack 124 to a device for connecting the human body with the ground, by using the object wiring, can offer an enhanced effect.

I claim:

1. A static eliminator comprising:

static electricity introduction means for collecting static electricity from a charged object;

a static electricity elimination circuit for receiving and eliminating the collected static electricity introduced via said static electricity introduction means;

said static electricity elimination circuit including discharging means for discharging the collected static electricity by discharging action, and exothermic means for eliminating the collected static electricity by exothermic action of the collected static electricity; and said discharge means and said exothermic means being formed as a plurality of groups having varying performance for eliminating static electricity in association with a magnitude of electrostatic voltage charged onto the charged object.

2. A static eliminator as claimed in claim 1, wherein said discharging means is enclosed by granitic earth.

3. A static eliminator as claimed in claim 1, wherein said exothermic means is enclosed by granitic earth.

4. A static eliminator as claimed in claim 1, wherein both said discharging means and said exothermic means are each enclosed by granitic earth.

5. A static eliminator as claimed in claim 1, wherein said discharging means includes a discharge electrode for corona discharge by the collected static electricity.

6. A static eliminator as claimed in claim 1, wherein said exothermic means includes a heater for generating Joule's heat by the collected static electricity.

7. A static eliminator in accordance with claim 1 wherein said discharging means includes a plurality of discharge electrodes and wherein said exothermic means includes a plurality of heating elements and wherein each of said discharge electrodes is paired with one of said heating elements.

* * * * *